US006968797B2

(12) United States Patent
Persson

(10) Patent No.: US 6,968,797 B2
(45) Date of Patent: Nov. 29, 2005

(54) METHOD FOR INSTALLING A SELF-FLOATING DECK STRUCTURE ONTO A BUOYANT SUBSTRUCTURE

(76) Inventor: Tor Persson, 12228 N. Shadow Cove Dr., Houston, TX (US) 77082

( * ) Notice: Subject to any disclaimer, the term of this patent is extended or adjusted under 35 U.S.C. 154(b) by 0 days.

(21) Appl. No.: 10/368,629

(22) Filed: Feb. 20, 2003

(65) Prior Publication Data

US 2004/0050315 A1 Mar. 18, 2004

Related U.S. Application Data

(60) Provisional application No. 60/410,310, filed on Sep. 13, 2002.

(51) Int. Cl.[7] ..... B63B 35/44
(52) U.S. Cl. ..... 114/264; 405/205
(58) Field of Search ..... 114/264, 265, 266, 114/267; 441/1, 2, 3; 405/200, 203, 204, 405/205, 206

(56) References Cited

U.S. PATENT DOCUMENTS 3,572,041 A * 3/1971 Graaf ..... 405/205
4,007,598 A * 2/1977 Tax ..... 405/200
5,456,622 A * 10/1995 Breivik et al. ..... 441/3
6,135,673 A * 10/2000 Horton et al. ..... 405/205
6,139,224 A * 10/2000 Michel et al. ..... 405/224
6,340,272 B1 * 1/2002 Runge et al. ..... 405/203
6,435,773 B1 * 8/2002 Khachaturian ..... 405/202
6,471,444 B1 * 10/2002 Pollack ..... 405/203
6,565,286 B2 * 5/2003 Carr et al. ..... 405/204
6,666,624 B2 * 12/2003 Wetch ..... 405/205

* cited by examiner

*Primary Examiner*—Andrew D. Wright
(74) *Attorney, Agent, or Firm*—Lord, Bissell & Brock; James H. Wynn; Roberta L. Hastreiter

(57) ABSTRACT

This invention provides a method for installing a self-floating deck structure with at least one recessed cavity on the bottom of the self-floating deck structure onto a buoyant substructure. The self-floating deck structure is aligned over a submerged buoyant substructure and the top of the buoyant substructure is inserted into a recessed cavity in the self-floating deck structure until the buoyant substructure mates with the self-floating deck structure at a point above the water surface. The self-floating deck and the buoyant substructure are connected by welding or one or more mechanical device.

27 Claims, 15 Drawing Sheets

METHOD FOR INSTALLING A SELF-FLOATING DECK STRUCTURE ONTO A BUOYANT SUBSTRUCTURE

CROSS-REFERENCE TO RELATED APPLICATION

This application claims priority from U.S. Provisional Patent Application Ser. No. 60/410,310, filed on Sep. 13, 2002, titled Method for Installing a Self-Floating Deck Structure Onto a Buoyant Substructure. Provisional Patent Application U.S. Ser. No. 60/410,310 and all disclosures therein are hereby incorporated into this application by reference.

BACKGROUND OF THE INVENTION

Field of the Invention

The present invention is related to a method for installing a self-floating deck structure onto a buoyant substructure of an offshore platform, such as is used in the exploitation of petroleum reserves.

In the past, installation of offshore deck structures generally required the use of a floating barge or vessel with a large crane to lift the deck structure and place it on the substructure. This method has numerous shortcomings, including the high cost of the barge or vessel mounted cranes and scheduling the availability of such barges or vessels. In some cases, the deck structure is so heavy that the structures cannot be lifted in one piece and have to be installed in multiple lifts. A Deck structure installed by barge or vessel mounted cranes often require additional structural reinforcement to withstand the forces attributable to the lifting of the deck structures. These factors increase the overall cost of the project by increasing material and construction costs, and hookup and commissioning work offshore, which significantly increases the expense of the project.

Recently integrated float over decks have been installed in various locations. These installations have typically utilized a deck mounted on a barge or barges to transport the deck structure to the installation location. Once at the installation site in the case where a single barge is utilized, the barge is typically positioned between the legs of the supporting structure. The deck structure is then lowered onto the legs of the support structure, typically either by ballasting the barge or by lowering jacks that support the deck structure on the barge.

In some instances a specifically designed barge can be utilized which can be positioned around or outside of the legs of the support structure. However, it increases the installation cost of the project to build a new barge or to modify an existing barge for such a purpose.

In other instances multiple barges can be utilized to transport and install the deck structure. When multiple barges are utilized they usually are positioned outside of the legs of the support structure that is fixed to the seabed. The barges are then ballasted to lower the deck onto the legs of the support structure. Alternatively, the deck structure can be mounted on jacks that are installed on the barges and the jacks can lower the deck structure onto the support structure.

The use of multiple barges can also be utilized to install a deck over a buoyant substructure. The deck structure mounted on multiple barges can then be positioned over a buoyant substructure that has been sufficiently ballasted to create clearance between the top of the buoyant substructure and the bottom of the deck structure. Once the deck is correctly aligned over the buoyant substructure, the substructure can be deballasted until the top of the substructure mates with the deck structure. The deballasting can continue until the deck structure is installed at the correct elevation above the water surface. The disadvantage of this method is the decrease in stability due to the use of multiple barges. The method is also susceptible to delays and potential damage to the deck structure and buoyant substructure due to wave action or swells.

SUMMARY OF THE INVENTION

The present invention provides a method to install a self-floating deck structure onto a buoyant substructure. A line connected to a lifting device located on the self-floating deck structure is lowered from the self-floating deck structure through a recessed cavity in the bottom of the deck structure and connected to the top surface of the buoyant substructure. The buoyant substructure is then sufficiently submerged below the water surface by ballasting until the top surface of the buoyant substructure is below the bottom surface of the self-floating deck structure to allow the self-floating deck structure to be positioned over the submerged buoyant substructure. The line connected to the lifting device supports the submerged buoyant substructure to prevent it from sinking deeper than is required for installing the self-floating deck structure onto the buoyant substructure. The recessed cavity of the self-floating deck structure is positioned and aligned over the submerged buoyant substructure and the lifting device retracts the line to lift the buoyant substructure until the top surface of the buoyant substructure is inserted within the recessed cavity of the self-floating deck structure and mates with the ceiling surface of the recessed cavity of the self-floating deck structure above the water surface. The buoyant substructure is then deballasted to raise the self-floating deck structure to a predetermined elevation above the water surface.

BRIEF DESCRIPTION OF THE DRAWINGS

For a further understanding of the nature of the present invention reference should be made to the following detailed description, taken in conjunction with the accompanying drawings in which like parts are given like reference numerals, and wherein.

DETAILED DESCRIPTION OF THE PREFERRED EMBODIMENT

Figure 1A:
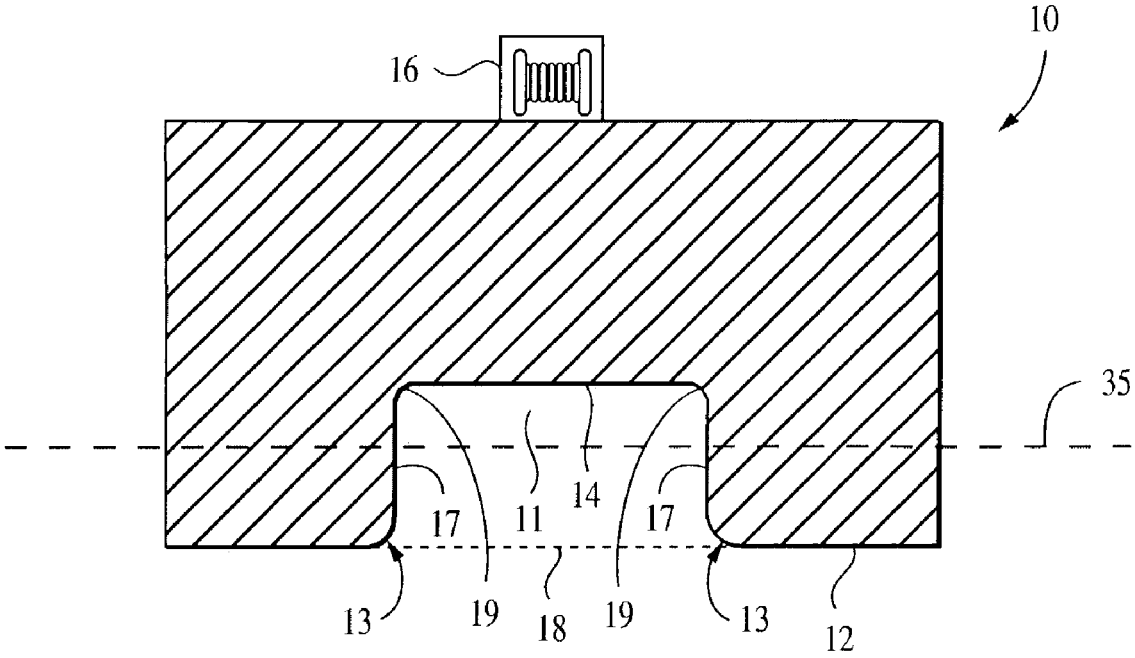
FIG. 1*a* is a side view of a self-floating deck structure.

In a first aspect the present invention provides for a method for installing a self-floating deck structure onto a buoyant substructure said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) ballasting the buoyant substructure below the water surface until the buoyant substructure top surface is below the bottom surface of the self-floating deck structure and the buoyant substructure is suspended from the self-floating deck structure by at least one line connected to at least one lifting device;

(f) positioning the self-floating deck structure over the buoyant substructure so that the recessed cavity of the self-floating deck structure is aligned over the buoyant substructure top surface;

(g) activating at least one lifting device to lift the buoyant substructure top surface up into the recessed cavity using at least one lifting device until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface.

In a second aspect the present invention provides for a method for installing a self-floating deck structure onto a buoyant substructure said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming a circumferential edge of the deck support leg, each deck support leg top surface and the deck support leg sidewall adjacent to said deck support leg top surface being adapted and sized to fit within a recessed cavity present in the self-floating deck structure;

(c) positioning said self-floating deck structure adjacent to said buoyant substructure;

(d) connecting at least one line connected to at least one lifting device located on the self-floating deck structure to the buoyant substructure;

(e) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(f) positioning the self-floating deck structure over the buoyant substructure so that each of the recessed cavities of the self-floating deck structure are aligned over a deck support leg top surface present on the buoyant substructure;

(g) activating each lifting device to lift the buoyant substructure up until each deck support leg top surface is inserted into a recessed cavity of the self-floating deck structure and each deck support leg top surface mates with a recessed cavity ceiling surface at a point above the water surface;

(h) connecting the self-floating deck structure to the buoyant substructure by welding or by a plurality of mechanical devices; and (i) deballasting the buoyant substructure to raise the self-floating deck structure to a predetermined elevation above the water surface.

In a third aspect the present invention provides for a method for installing a self-floating deck structure onto a buoyant substructure said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning the self-floating deck structure adjacent to said buoyant substructure and connecting at least one line connected to at least one lifting device located on the self-floating deck structure to the buoyant substructure;

(d) ballasting the buoyant substructure below the water surface until the buoyant substructure bottom surface rests upon a seabed present in the water deep enough so that the buoyant substructure top surface is below the bottom surface of the self-floating deck structure;

(e) positioning the self-floating deck structure over the submerged buoyant substructure so that the recessed cavity of the self-floating deck structure is aligned over the buoyant substructure top surface;

(f) activating at least one lifting device to lift the buoyant substructure top surface up into the recessed cavity of the self-floating deck structure until the buoyant substructure top surface mates with the recessed cavity ceiling surface at a point above the water surface;

(g) connecting the self-floating deck structure to the buoyant substructure by welding or by one or more mechanical devices; and (h) deballasting the buoyant substructure to raise the self-floating deck structure to a predetermined elevation above the water surface suitable for towing the connected self-floating deck structure and buoyant substructure to a final installation location.

In a fourth aspect the present invention provides for a method for installing a self-floating deck structure onto a buoyant substructure said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that has a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) positioning the self-floating deck structure adjacent to said buoyant substructure and connecting at least one line connected to at least one lifting device present on the self-floating deck structure to the buoyant substructure;

(d) ballasting the buoyant substructure below the water surface until the buoyant substructure bottom surface rests upon a seabed present in the water deep enough so that each deck support leg top surface is positioned below the bottom surface of the self-floating deck structure;

(e) positioning the self-floating deck structure over the buoyant substructure so that each of the recessed cavities of the self-floating deck structure is aligned over a deck support leg top surface of the buoyant substructure;

(f) activating at least one lifting device to lift the buoyant substructure up until each deck support leg top surface is inserted into a recessed cavity of the self-floating deck structure and each deck support leg top surface mates with the recessed cavity ceiling surface at a point above the water surface;

(g) connecting the self-floating deck structure to the buoyant substructure by welding or by one or more mechanical devices; and (h) deballasting the buoyant substructure to raise the self-floating deck structure to a predetermined elevation above the water surface.

In a fifth aspect the present invention provides for a method for installing a self-floating deck structure onto a buoyant substructure said method comprising the steps of:

(a) providing a self-floating deck structure with a bottom surface and a recessed cavity extending upward from said bottom surface of the self-floating deck structure, said recessed cavity comprising an opened end, at least one recessed cavity sidewall and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and said buoyant substructure bottom surface being connected by at least one buoyant substructure sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) providing at least one line that is connected to the self-floating deck structure;

(e) connecting each line to the buoyant substructure;

(f) ballasting the buoyant substructure below the water surface until the buoyant substructure top surface is below the bottom surface of the self-floating deck structure and the buoyant substructure is suspended from the self-floating deck structure by at least one line;

(g) positioning the self-floating deck structure over the buoyant substructure so that the recessed cavity of the self-floating deck structure is aligned over the buoyant substructure top surface;

(h) raising the buoyant substructure top surface up into the recessed cavity by adjusting the buoyancy of the buoyant substructure until the buoyant substructure top surface mates with the recessed cavity ceiling surface at a point above the water surface;

(i) connecting the self-floating deck structure to the buoyant substructure by welding or by one or more mechanical device; and (j) deballasting the buoyant substructure to raise the self-floating deck structure to a predetermined elevation above the water surface.

In a sixth aspect the present invention provides for a method for installing a self-floating deck structure onto a buoyant substructure said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewalls and the recessed cavity ceiling surfaces forming at least one upper circumferential edge of the recessed cavity, and the intersection of the recessed cavity sidewalls and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, said buoyant substructure having a buoyant substructure bottom surface, each deck support leg having a deck support leg top surface and a deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) positioning said self-floating deck structure adjacent to said buoyant substructure;

(d) providing at least one line that is connected to said self-floating deck structure;

(e) connecting each line to the buoyant substructure;

(f) ballasting the buoyant substructure below the water surface until the deck support leg top surface of each deck support leg of the buoyant substructure is below the bottom surface of the self-floating deck structure and the buoyant substructure is suspended from at least one line connected to the self-floating deck structure;

(g) positioning the self-floating deck structure over the buoyant substructure so that each of the recessed cavities of the self-floating deck structure are aligned over a deck support leg top surface of the buoyant substructure;

(h) raising the buoyant substructure up by adjusting the buoyancy of the buoyant substructure until each of deck support leg top surface is inserted into a recessed cavity of the self-floating deck structure and each deck support leg top surface mates with a recessed cavity ceiling surface at a point above the water surface;

(i) connecting the self-floating deck structure to the buoyant substructure of the self-floating deck structure by welding or by one or more mechanical devices; and (j) deballasting the buoyant substructure to raise the self-floating deck structure to a predetermined elevation above the water surface.

In a seventh aspect the present invention provides for a method for installing a self-floating deck structure onto a buoyant substructure said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning the self-floating deck structure adjacent to said buoyant substructure that has been ballasted below the water surface so that the buoyant substructure bottom surface rests on a seabed present in the water deep enough such that the buoyant substructure top surface is below the bottom surface of the self-floating deck structure;

(d) positioning the self-floating deck structure over the submerged buoyant substructure so that the recessed cavity of the self-floating deck structure is aligned over the buoyant substructure top surface;

(e) raising the buoyant substructure top surface up into the recessed cavity of the self-floating deck structure by adjusting the buoyancy of the buoyant substructure until the buoyant substructure top surface mates with the recessed cavity ceiling surface at a point above the water surface;

(f) connecting the self-floating deck structure to the buoyant substructure by welding or by one or more mechanical devices; and (g) deballasting the buoyant substructure to raise the self-floating deck structure to a predetermined elevation above the water surface suitable for towing the connected self-floating deck structure and buoyant substructure to a final installation location.

In an eighth aspect the present invention provides for a method for installing a self-floating deck structure onto a buoyant substructure said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) ballasting the buoyant substructure below the water surface until the buoyant, substructure bottom surface rests on a seabed present in the water deep enough so that each deck support leg top surface is below the bottom surface of the self-floating deck structure;

(d) positioning the self-floating deck structure over the buoyant substructure so that each of the recessed cavities of the self-floating deck structure are aligned over a deck support leg top surface of the buoyant substructure;

(e) raising the buoyant substructure up by adjusting the buoyancy of the buoyant substructure until each deck support leg top surface is inserted into a recessed cavity of the self-floating deck structure and each deck support leg top surface mates with a recessed cavity ceiling surface at a point above the water surface;

(f) connecting the self-floating deck structure to the buoyant substructure of the self-floating deck structure by welding or by one or more mechanical devices; and (g) deballasting the buoyant substructure to raise the self-floating deck structure to a predetermined elevation above the water surface.

In a ninth aspect the present invention provides for a method for installing a self-floating deck structure onto a buoyant substructure said method comprising the steps of:

(a) providing a self-floating deck structure with a bottom surface and a recessed cavity extending upward from said bottom surface of the self-floating deck structure, said recessed cavity comprising an open end, a recessed cavity ceiling surface at least one recessed cavity sidewall, said recessed cavity ceiling surface being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity, the dimension of the upper circumferential edge of the recessed cavity being smaller than the dimension of the lower circumferential edge of the recessed cavity causing the recessed cavity sidewall to taper inward as it progresses from said lower circumferential edge of the recessed cavity towards said upper circumferential edge of the recessed cavity;

(b) providing a buoyant substructure that is capable of being fully submerged below a water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming at least one upper circumferential edge of the buoyant substructure, the circumferential dimension of the buoyant substructure top surface being larger than the circumferential dimension of the recessed cavity ceiling surface but smaller than the circumferential dimension of the lower circumferential edge of the recessed cavity, the buoyant substructure top surface and the buoyant substructure sidewall adjacent to the buoyant substructure top surface being adapted to fit within the recessed cavity of the self-floating deck structure, and being sized so that the buoyant substructure sidewall mates snugly with the recessed cavity sidewall when the buoyant substructure top surface is inserted in the recessed cavity;

(c) positioning said self-floating deck structure adjacent to said buoyant substructure;

(d) lowering at least one line connected to at least one lifting device located on the self-floating deck structure and connecting each line to the buoyant substructure;

(e) ballasting the buoyant substructure below the water surface until the buoyant substructure top surface is below the bottom surface of the self-floating deck structure and the buoyant substructure is suspended from the self-floating deck structure by at least one line connected to at least one lifting device;

(f) positioning the self-floating deck structure over the buoyant substructure so that the recessed cavity of the self-floating deck structure is aligned over the buoyant substructure top surface;

(g) activating at least one lifting device to lift the buoyant substructure top surface up into the recessed cavity using at least one lifting device until the buoyant substructure sidewall mates with the recessed cavity sidewall;

(h) connecting the self-floating deck structure to the buoyant substructure by welding or by one or more mechanical devices; and (i) deballasting the buoyant substructure to raise the self-floating deck structure to a predetermined elevation above the water surface.

In a tenth aspect the present invention provides for a method for installing a self-floating deck structure onto a buoyant substructure said method comprising the steps of:

(a) providing a self-floating deck structure with a bottom surface and at least one recessed cavity extending upward from said bottom surface of the self-floating deck structure, each recessed cavity comprising an open end, at least one recessed cavity sidewall and a recessed cavity ceiling surface, each recessed cavity ceiling surface being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs and that is capable of being fully submerged below the water surface, each deck support leg having a deck support leg top surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(f) positioning the self-floating deck structure over the buoyant substructure so that at least one recessed cavity of the self-floating deck structure is aligned over a plurality of deck support leg top surfaces of the buoyant substructure;

(g) activating at least one lifting device to lift the buoyant substructure up until a plurality of deck support leg top surfaces are inserted into a recessed cavity of the self-floating deck structure and each deck support leg top surface mates with a recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface.

In an eleventh aspect the present invention provides for a method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(f) ballasting the buoyant substructure below the water surface until the buoyant substructure top surface is below the bottom surface of the self-floating deck structure and the buoyant substructure is suspended from at least one buoyancy tank by at least one line connected to at least one buoyancy tank;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

In a twelfth aspect the present invention provides for a method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(e) ballasting the buoyant substructure below the water surface until the buoyant substructure top surface is below the bottom surface of the self-floating deck structure and the buoyant substructure is suspended from at least one buoyancy tank by at least one line connected to at least one buoyancy tank;

(f) positioning the self-floating deck structure over the buoyant substructure so that the recessed cavity of the self-floating deck structure is aligned over the buoyant substructure top surface;

(g) raising the buoyant substructure top surface up into the recessed cavity by adjusting the buoyancy of the buoyant substructure until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface.

In a thirteenth aspect the present invention provides for a method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) providing at least one floating vessel, each floating vessel having at least one line having one end connected to said floating vessel and an opposite end connected to the buoyant substructure to prevent said buoyant substructure from sinking to the seabed after the buoyant substructure is ballasted below the water surface;

(f) ballasting the buoyant substructure below the water surface until the buoyant substructure top surface is below the bottom surface of the self-floating deck structure and the buoyant substructure is suspended from at least one floating vessel by at least one line connected to at least one floating vessel;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

In a fourteenth aspect the present invention provides for a method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) providing at least one floating vessel, each floating vessel having at least one line having one end connected to said floating vessel and an opposite end connected to the buoyant substructure to prevent said buoyant substructure from sinking to the seabed after the buoyant substructure is ballasted below the water surface;

(e) ballasting the buoyant substructure below the water surface until the buoyant substructure top surface is below the bottom surface of the self-floating deck structure and the buoyant substructure is suspended from at least one floating vessel by at least one line connected to at least one floating vessel;

(f) positioning the self-floating deck structure over the buoyant substructure so that the recessed cavity of the self-floating deck structure is aligned over the buoyant substructure top surface;

(g) raising the buoyant substructure top surface up into the recessed cavity by adjusting the buoyancy of the buoyant substructure until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface.

Specific methods within the scope of the present invention include, but are not limited to, the methods discussed in detail herein and/or illustrated in the drawings that are present herein.

Contemplated equivalents of the methods described and illustrated herein and/or illustrated in the drawings contained herein include methods which otherwise correspond thereto, and which have the same general properties and/or components thereof, wherein one or more simple or other variations of components, materials or steps are made.

All of the structures and components used to carry out the methods of the present invention, such as self-floating deck structures, buoyant substructures, lifting devices and lines, are commercially available from sources known by those of ordinary skill in the art.

For the purpose of illustrating structures that may be employed in the methods of the present invention, there are shown in the drawings, which form a material part of this disclosure, different views of various self-floating deck structures and buoyant substructures that may be employed in the methods of the present invention.

The different components of the various self-floating deck structures and buoyant substructures that may be employed in the methods of the present invention may be generally arranged in the manner shown in the drawings, or described hereinbelow. However, the present invention is not limited to methods employing self-floating deck structures and buoyant substructures having the precise arrangements, configurations, dimensions and/or instrumentalities shown in these drawings, or described hereinbelow. These arrangements, configurations, dimensions and instrumentalities may be otherwise, as circumstances require.

Different specific embodiments of self-floating deck structures and buoyant substructures that may be employed in the methods of the present invention will now be described with reference to the drawings.

Figure 1B:
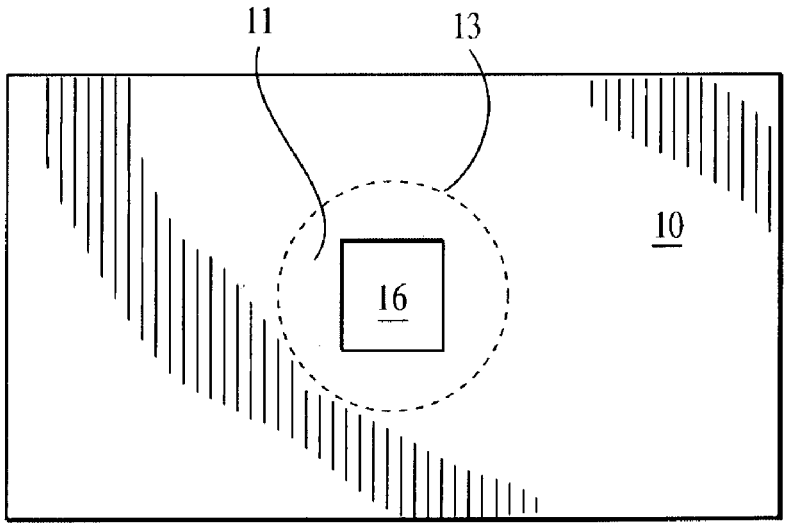
FIG. 1*b* is a plan view of a self-floating deck structure.

As shown in FIG. 1*a* and FIG. 1*b*, the self-floating deck structure 10 has a recessed cavity 11 extending upward into the self-floating deck structure 10 from the bottom surface 12 of the self-floating deck structure 10 having circumferential dimensions that are slightly larger than the circumference of the top surface 21 of the buoyant substructure 20. The recessed cavity 11 is formed by an open end 18, at least one recessed cavity sidewall 17 and a recessed cavity ceiling surface 14. The intersection of the recessed cavity sidewall 17 and the recessed cavity ceiling surface 14 forms an upper circumferential edge 19 of the recessed cavity 11. The intersection of the recessed cavity sidewall 17 and the bottom surface 12 of the self-floating deck structure 10 forms at least one lower circumferential edge 13 of the recessed cavity 11. The lower circumferential edge 13 of the recessed cavity 11 is preferably rounded to facilitate the insertion of the top surface 21 of a buoyant substructure 20 into the recessed cavity 11 of the self-floating deck structure 10. The upper circumferential edge 19 of the recessed cavity 11 present in the self-floating deck structure 10 is also preferably rounded to facilitate the mating of the top surface 21 of a buoyant substructure 20 to the ceiling surface 14 of the recessed cavity 11. Although, in a preferred embodiment of the methods of the present invention, the upper 19 and lower 13 circumferential edges of the recessed cavity 11 are rounded, the inventive method can be practiced without the upper 19 or lower 13 circumferential edges of the recessed cavity 11 being rounded. The circumferential dimensions of the upper and lower circumferential edges of the recessed cavity of the buoyant substructure can vary widely as is known by those skilled in the art.

Figure 2:
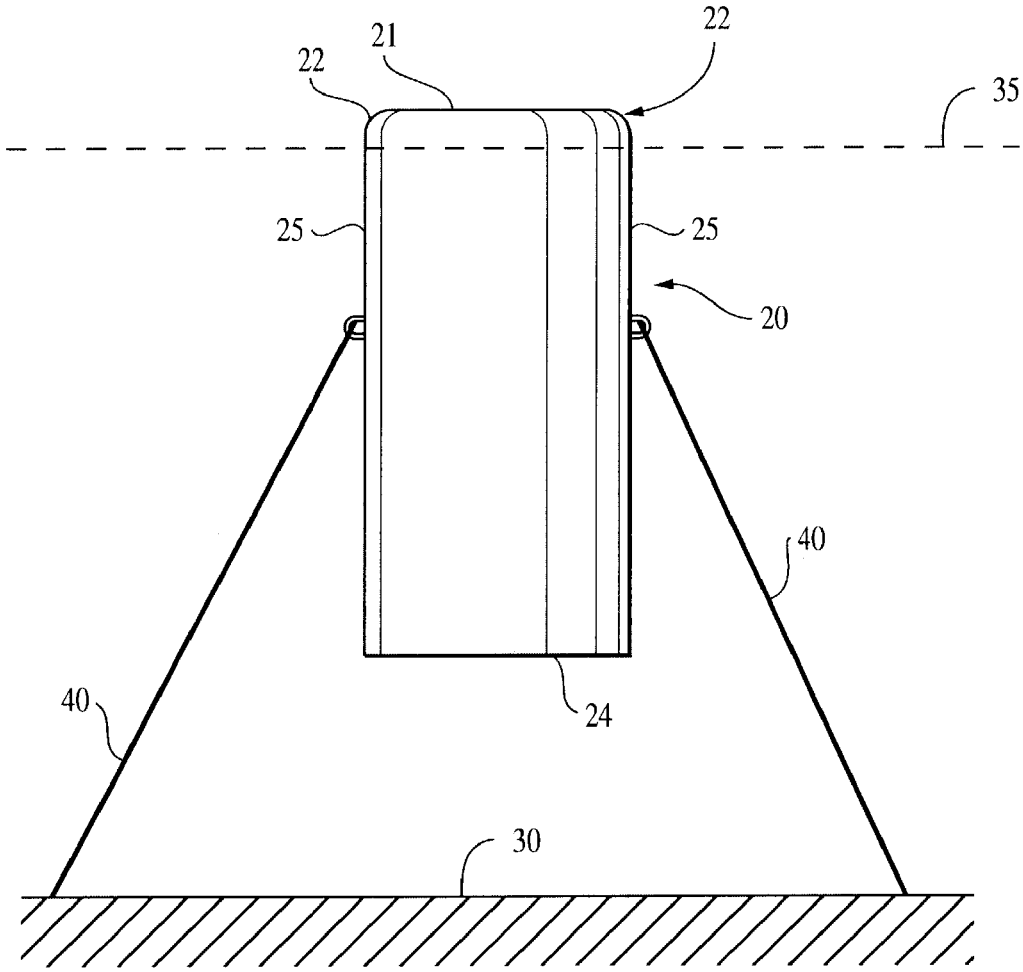
FIG. 2 is a side view of a buoyant substructure after it has been installed by mooring it to the seabed.

As is shown in FIG. 2 the buoyant substructure 20 may be installed and connected to a seabed 30 located below the water surface 35 by mooring lines 40 prior to the commencement of the deck installation. Although it is preferable to do this, it is recognized that the inventive methods can be practiced without the buoyant substructure 20 being previously installed at a permanent location. The buoyant substructure 20 has a top surface 21 and a bottom surface 24. The top and bottom surfaces of the buoyant substructure 20 are connected by at least one buoyant substructure sidewall 25. The intersection of the buoyant substructure top surface 21 and the buoyant substructure sidewall 25 form an upper circumferential edge 22 of the buoyant substructure 20. The buoyant substructure top surface 21 and the buoyant substructure sidewall 25 adjacent to the buoyant substructure top surface 21 are adapted and sized to fit within the recessed cavity 11 of the self-floating deck structure 10. The upper circumferential edge 22 of the top surface 21 of the buoyant substructure 20 preferably has a rounded shape to facilitate the insertion of the top surface 21 of the buoyant substructure 20 into the recessed cavity 11 of the self-floating deck structure 10. Although the preferred embodiment of the methods of the present invention utilizes a rounded upper circumferential edge 22 of the buoyant substructure 20, the inventive methods can be practiced without the upper circumferential edge 22 being rounded. The circumferential dimension of the upper circumferential edge of the buoyant substructure can vary widely as known by those skilled in the art. It is recognized that the inventive methods are also suitable for installing a self-floating deck structure 10 onto a buoyant substructure 20 prior to the buoyant substructure 20 being installed at its permanent installation location. In such a circumstance, the self-floating deck structure 10 can be installed onto the buoyant substructure 20 at a location other than the installation location. The combined buoyant substructure 20 and self-floating deck structure 10 can then be towed or transported to a final location where the combined structure can be installed.

Figure 3:
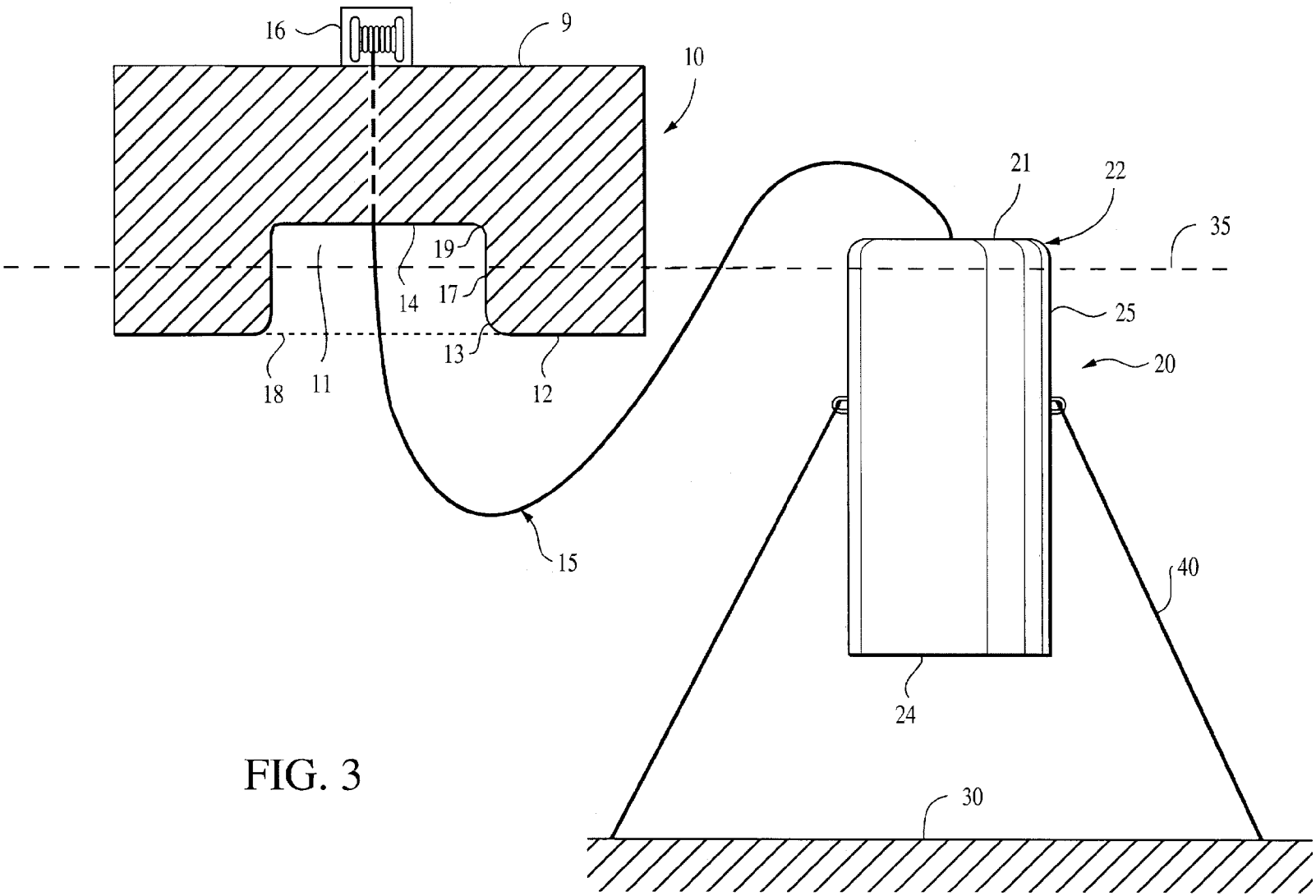
FIG. 3 is a side view of a self-floating deck structure connected by a lifting line present on a lifting device to an adjacent buoyant substructure.

Referring to FIG. 3, the self-floating deck structure 10 is positioned adjacent to the buoyant substructure 20, which has previously been installed. A line 15 connected to a lifting device 16 is lowered from the lifting device 16, which is preferably located on the top 9 of the self-floating deck structure 10, and is connected to the top surface 21 of the buoyant substructure 20. In a preferred embodiment, a single line 15 is utilized. However, it is recognized that the inventive methods can be practiced using multiple lines 15 and multiple lifting devices 16. The line 15 connected to the lifting device 16 can be made from rope, chain, wire cable or synthetic cable, or other material that can be used with the lifting device 16. In a preferred embodiment, a winch is used as the lifting device 16, for example, to retract the line 15. However, other suitable lifting devices 16 can be used, including a jack, a crane or drilling equipment. In a preferred embodiment, the lifting device 16 is located on the top of the self-floating deck structure 10. However, it is recognized that the lifting device 16 can be placed in other locations on or within the self-floating deck structure 10. It is recognized that the inventive methods can be practiced by utilizing a line or lines separate from that or those used to lift the buoyant substructure 20 to suspend the buoyant substructure 20 from the self-floating deck structure 10. It is also recognized that the inventive method can be practiced with the lifting line 15 connected to other points on the buoyant substructure 20.

Figure 4:
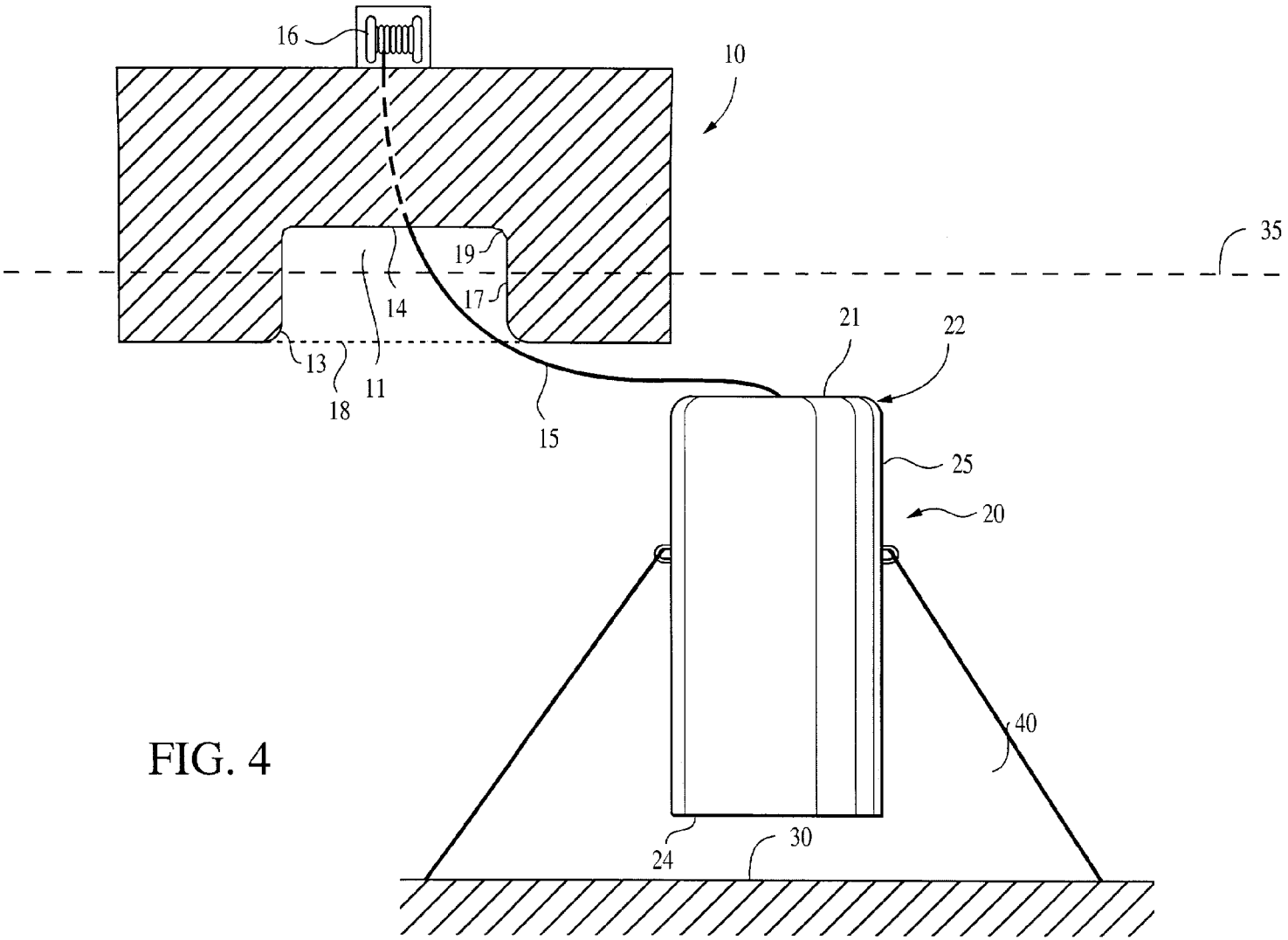
FIG. 4 illustrates a buoyant substructure submerged below the water surface while adjacent to a self-floating deck structure.

The buoyant substructure 20 is preferably ballasted until it is completely submerged below the water surface 35, as is seen in FIG. 4. As the buoyant substructure 20 is ballasted below the water surface 35, the lifting line 15 supports the buoyant substructure 20 and preferably prevents it from sinking further than is required for the installation of the self-floating deck structure 10 onto the buoyant substructure 20.

Figure 5:
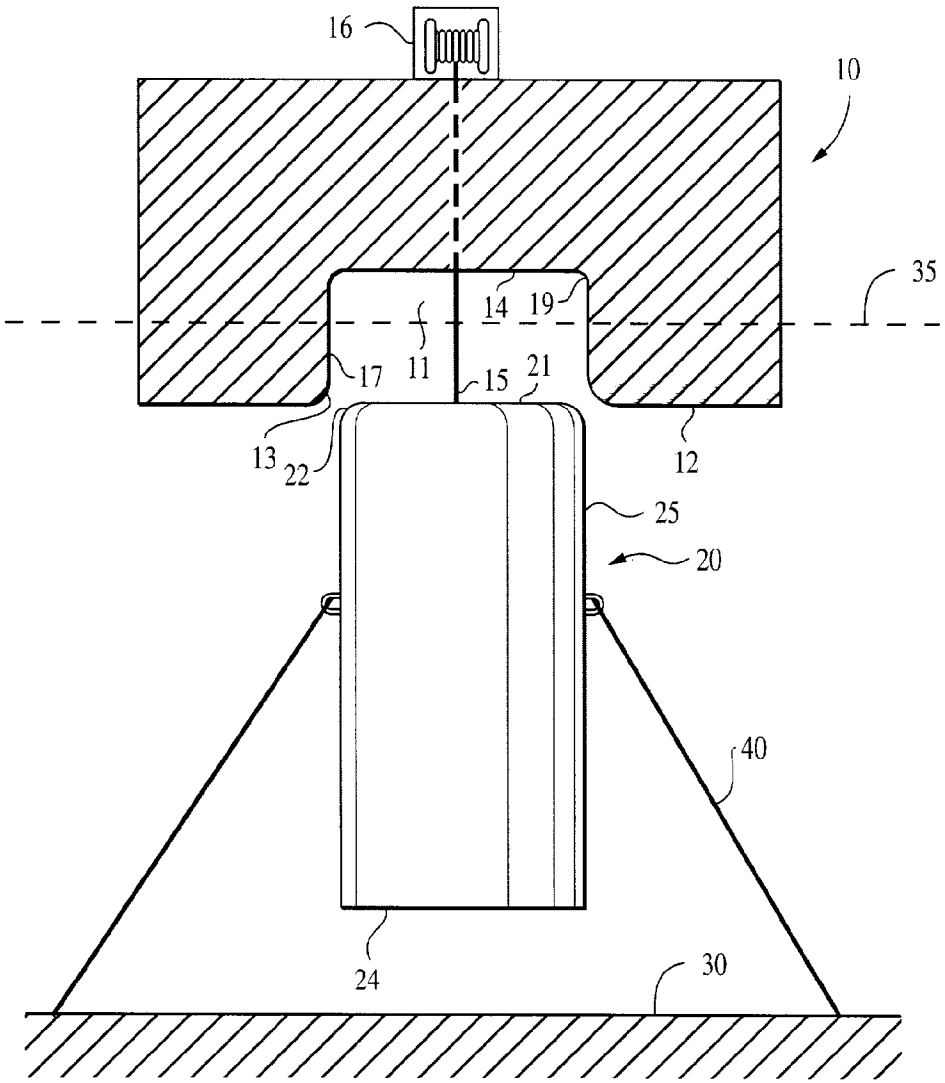
FIG. 5 illustrates a self-floating deck structure positioned over a submerged buoyant substructure with the submerged buoyant substructure suspended below the self-floating deck structure by the lifting device.

As is shown in FIG. 5, the self-floating deck structure 10 is preferably positioned over the submerged buoyant substructure 20 until the recessed cavity 11 of the self-floating deck structure 10 is aligned over the top surface 21 of the submerged buoyant substructure 20 while the submerged buoyant substructure 20 is suspended from the self-floating deck structure 10 by the line 15 connected to the lifting device 16.

Figure 6:
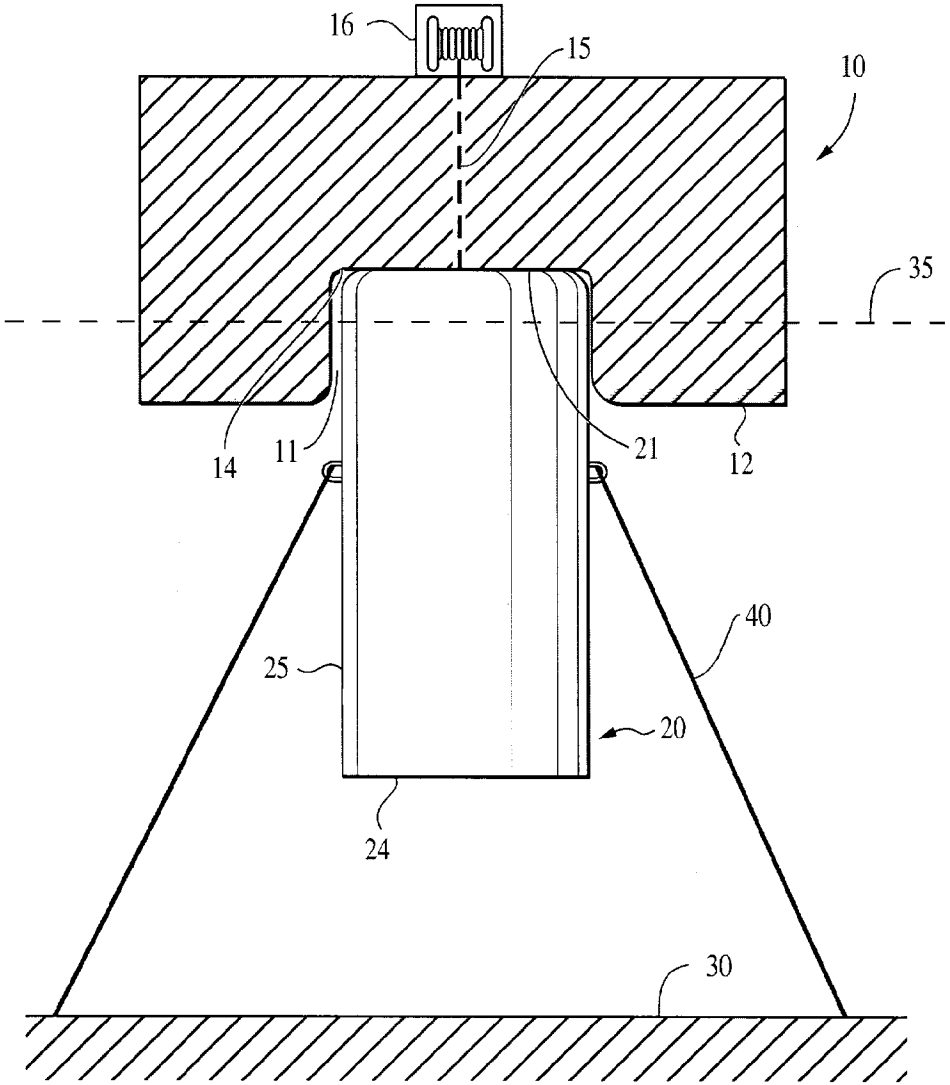
FIG. 6 illustrates a buoyant substructure after it has been raised by a lifting device to contact the mating surface of a self-floating deck structure.

As is seen in FIG. 6, the top surface 21 of the buoyant substructure 20 is preferably lifted up into the recessed cavity 11 of the self-floating deck structure 10 by the lifting device 16 retracting the line 15 connected thereto, lifting the top surface 21 of the buoyant substructure 20 until it contacts the ceiling surface 14 of the recessed cavity 11 of the self-floating deck structure 10 at a point above the water surface 35. After the top surface 21 of the buoyant substructure 20 has contacted the ceiling surface 14 of the recessed cavity 11 of the self-floating deck structure 10, the two structures can be further connected by welding or by a mechanical device or a plurality of mechanical devices.

Figure 7:
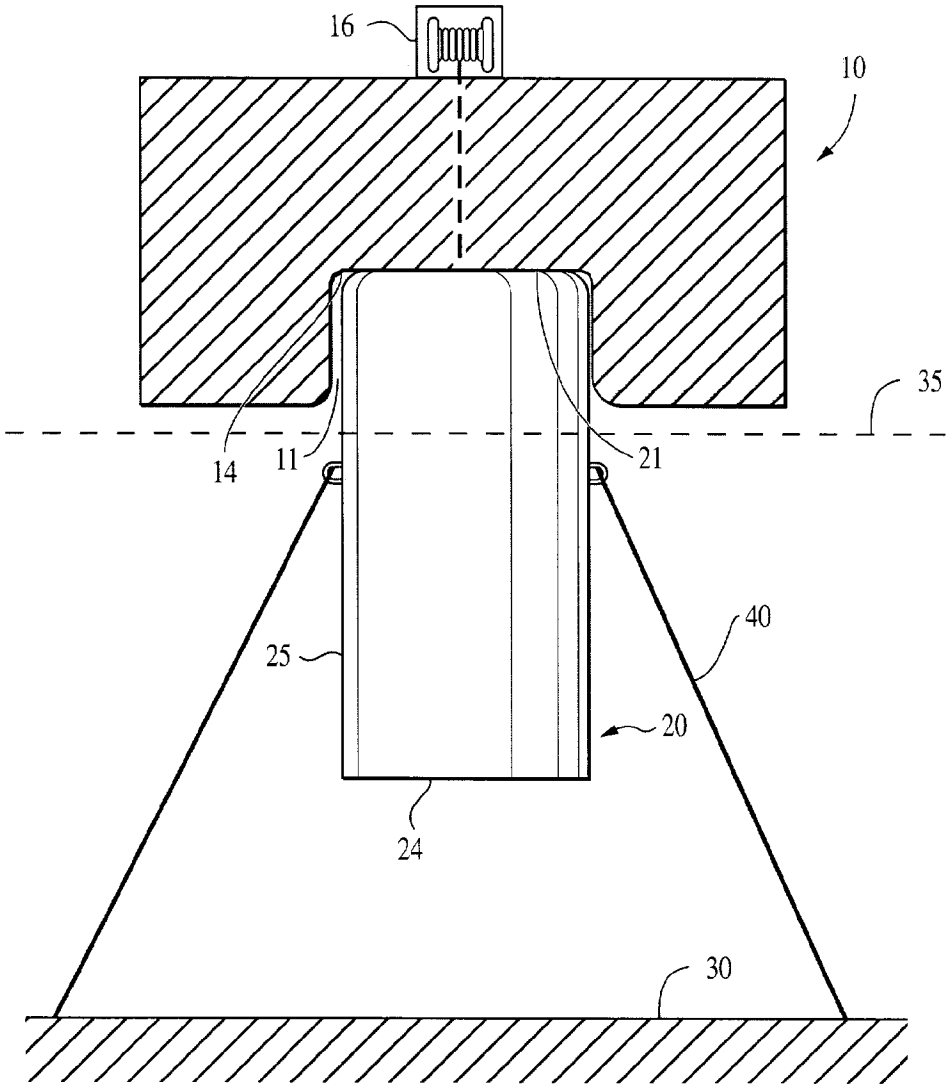
FIG. 7 illustrates a buoyant substructure connected to a self-floating deck structure at the correct installed elevation.

After the top surface 21 of the buoyant substructure 20 has mated with the ceiling surface 14 of the recessed cavity 11 of the self-floating deck structure 10, the buoyant substructure 20 is preferably deballasted to raise the self-floating deck structure 10 to a predetermined elevation above the water surface 35, as is illustrated in FIG. 7. The predetermined elevation is dependent upon a number of factors including but not limited to the predicated wave heights and predicated weather conditions at the installation location for the combined self-floating deck structure and buoyant substructure.

Figure 8:
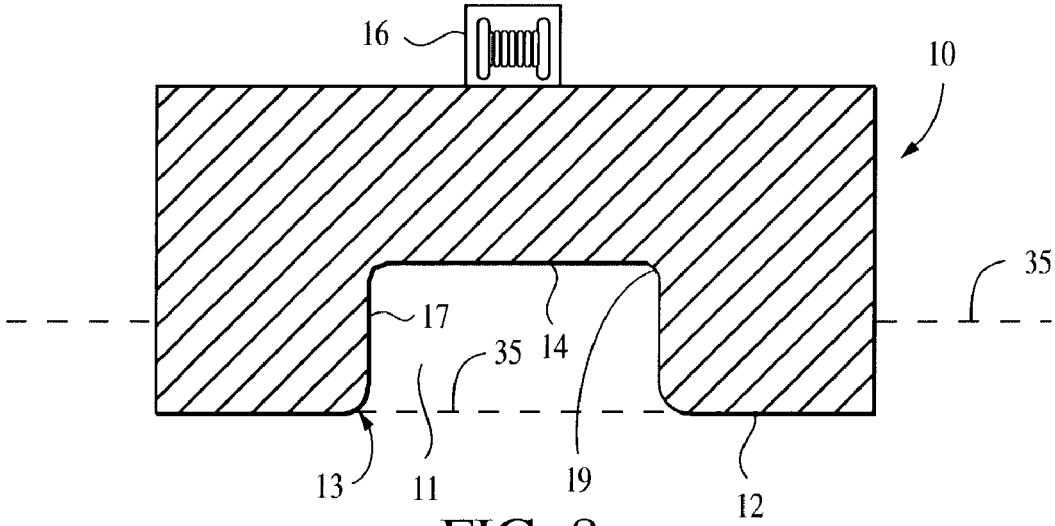
FIG. 8 illustrates an alternative embodiment of the inventive method where the water has been displaced from the recessed cavity of the self-floating deck structure by pumping compressed air (or other gas) into the recessed cavity.

In an alternative embodiment of the methods of the present invention, as is illustrated in FIG. 8, the water in the recessed cavity 11 of the self-floating deck structure 10 can be partially or completely displaced by pumping compressed air or other gas into the recessed cavity 11. The compressed air or other gas in the recessed cavity 11 of the self-floating deck structure 10 increases the displacement of the self-floating deck structure 10 and acts as a dampener to reduce the potential for impact between the top surface 21 of the buoyant substructure 20 and the ceiling surface 14 of the recessed cavity 11 of the self-floating deck structure 10.

Figure 9:
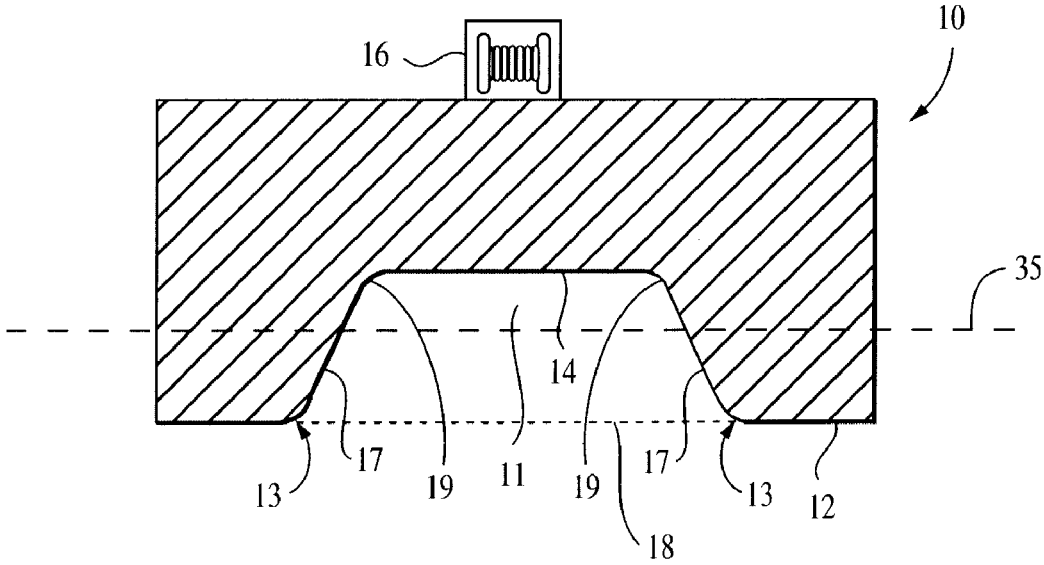
FIG. 9 illustrates an alternative embodiment of the inventive method showing a self-floating deck structure in which the sides of the recessed cavity of the self-floating deck structure taper inward from the bottom of the self-floating deck structure towards the top of the recessed cavity.

In an alternative embodiment of the methods of the present invention, as is shown in FIG. 9, the circumferential dimension of the upper circumferential edge 19 of the recessed cavity 11 is preferably smaller than the circumferential dimension of the lower circumferential edge 13 of the recessed cavity 11 causing the recessed cavity sidewall 17 to taper inward from the bottom surface 12 of the self-floating deck structure 10 as it progresses towards the ceiling surface 14 of the recessed cavity 11 to facilitate insertion of the top surface 21 of the buoyant substructure 20 into the recessed cavity 11 of the self-floating deck structure 10.

Figure 10:
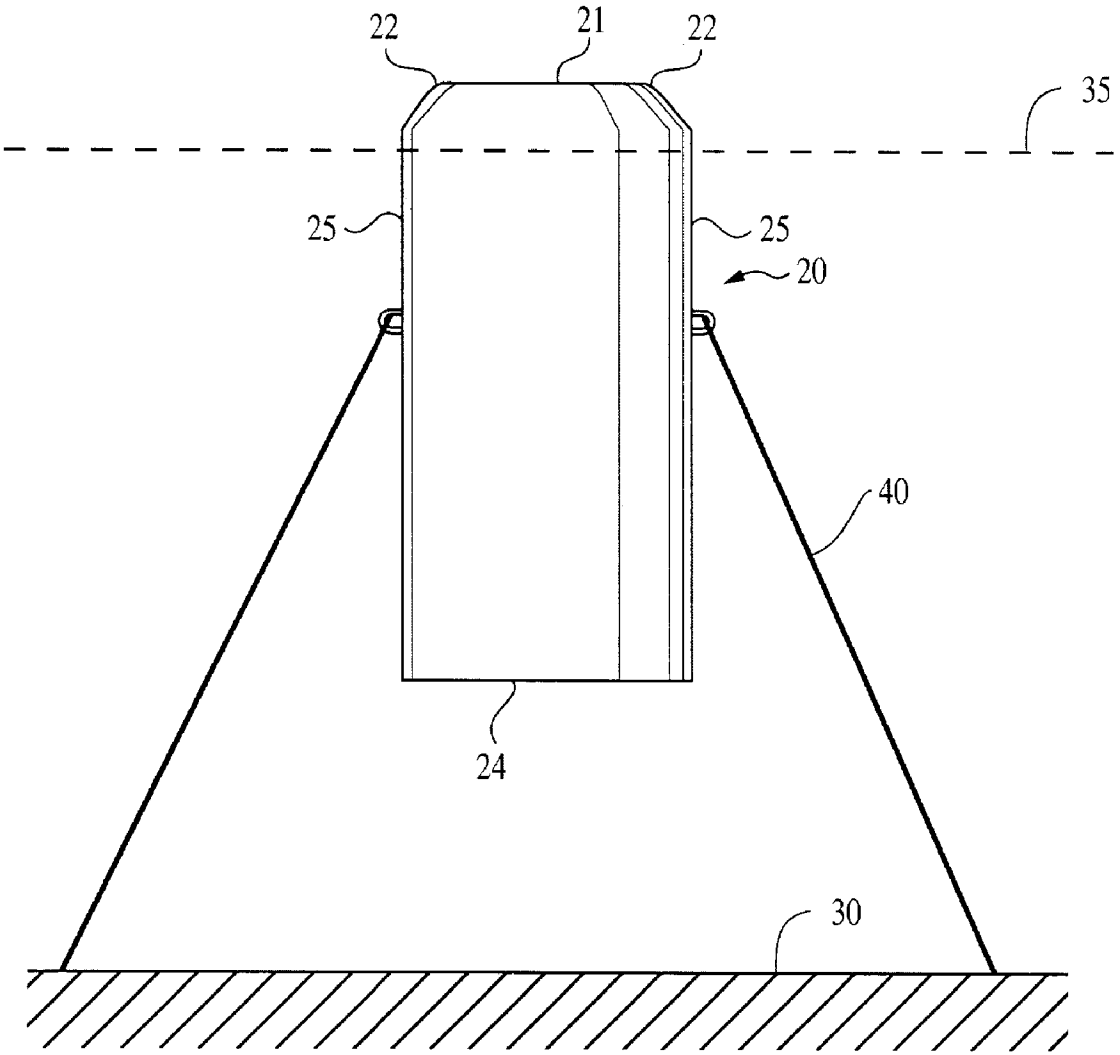
FIG. 10 illustrates an alternative embodiment of the inventive method showing the buoyant substructure where the sides of the buoyant substructure taper inward from the outer surface of the substructure.

In an alternative embodiment of the methods of the present invention, as is illustrated in FIG. 10, the circumferential dimension of the upper circumferential edge 22 of the buoyant substructure 20 is preferably smaller than the circumferential dimension of the buoyant substructure sidewall 25 adjacent to the buoyant substructure top surface 21, causing the buoyant substructure sidewall 25 adjacent to the buoyant substructure top surface 21 to taper inward as it progresses towards the top surface 21 of the buoyant substructure 20.

Figure 11A:
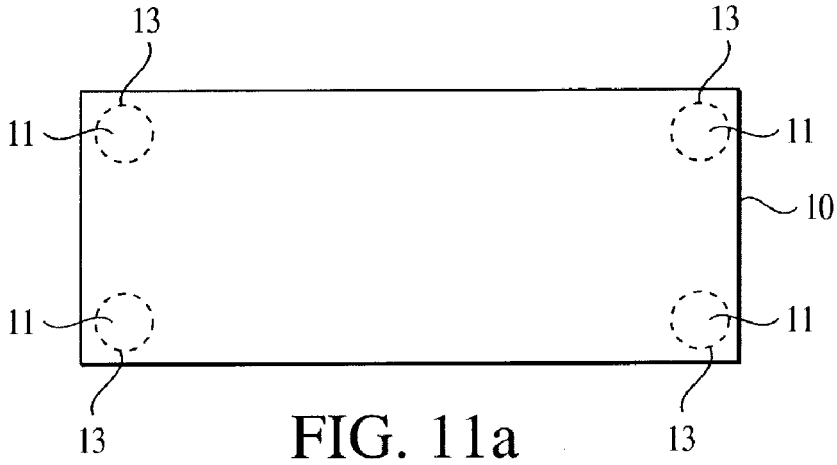
FIG. 11*a* illustrates a plan view of an alternative embodiment of the inventive method showing a self-floating deck structure that is supported by four deck support legs.
Figure 11B:
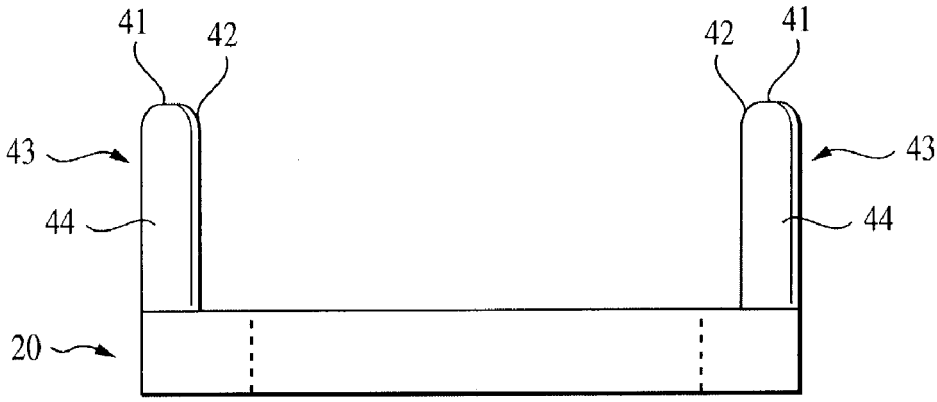
FIG. 11*b* illustrates a side view of an alternative embodiment of the inventive method showing a buoyant substructure with four deck support legs.
Figure 11C:
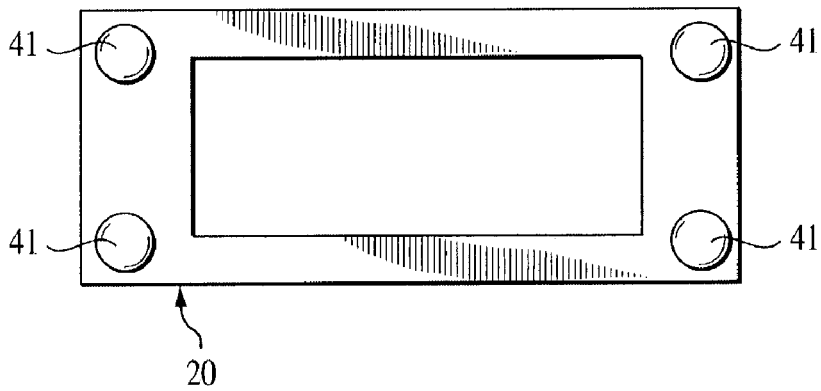
FIG. 11*c* illustrates a plan view of an alternative embodiment of the inventive method showing a buoyant substructure with four deck support legs.

In an alternative embodiment of the methods of the present invention, as is illustrated in FIG. 11*a*, the self-floating deck structure 10 has a plurality of recessed cavities 11 to accommodate the top surface 41 of a plurality of deck support legs 43 of the buoyant substructure 20. In the embodiment shown in FIG. 11*b* and FIG. 11*c*, the buoyant substructure 20 has four deck support legs 43. It is recognized that the inventive methods are not limited to the use of four deck support legs 43, but can be practiced with some other plurality of deck support legs 43 (three legs, five legs, six legs, etc.).

Figure 12A:
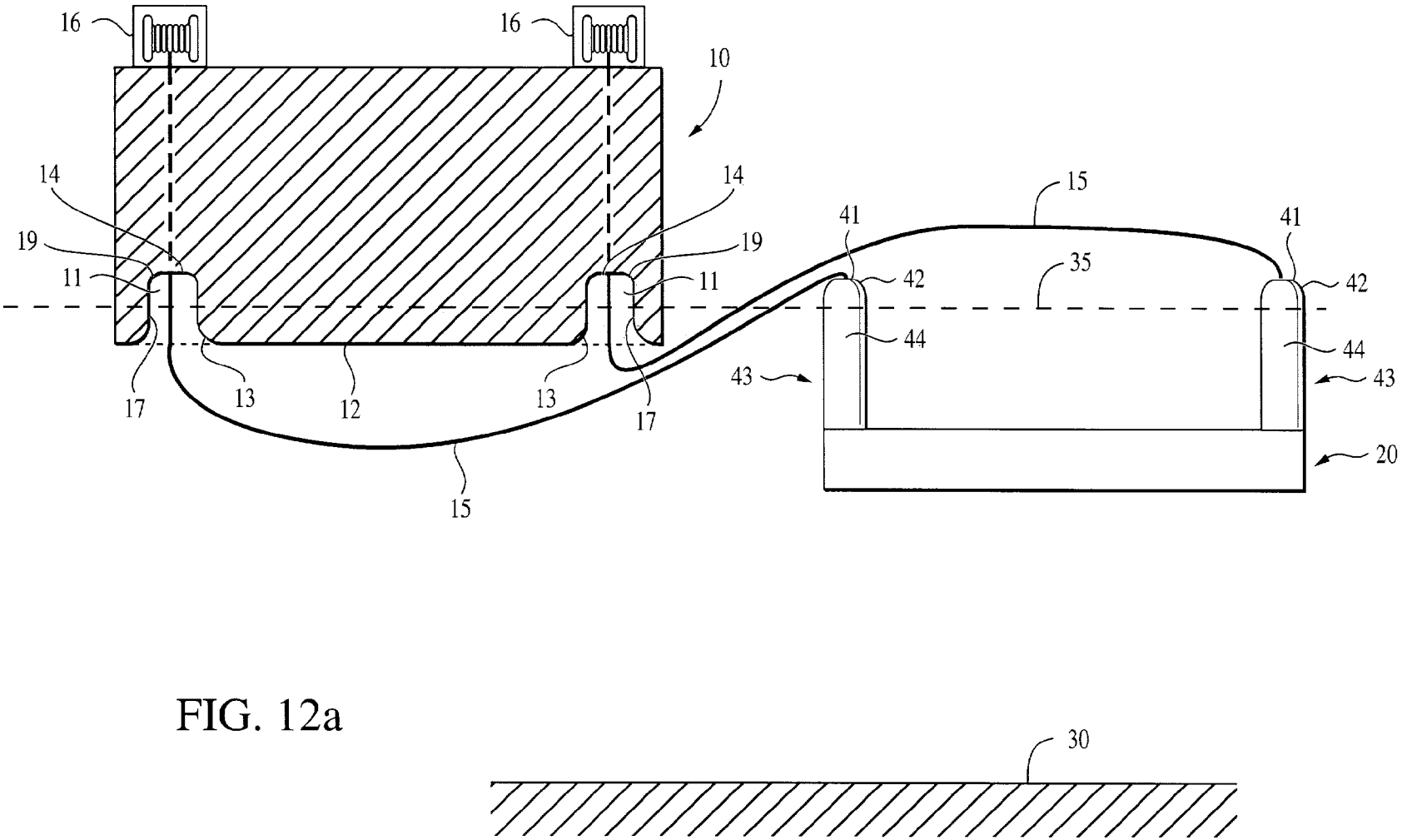
FIG. 12*a* illustrates an alternative embodiment of the inventive method showing a self-floating deck structure adjacent to a buoyant substructure having multiple deck support legs.
Figure 12B:
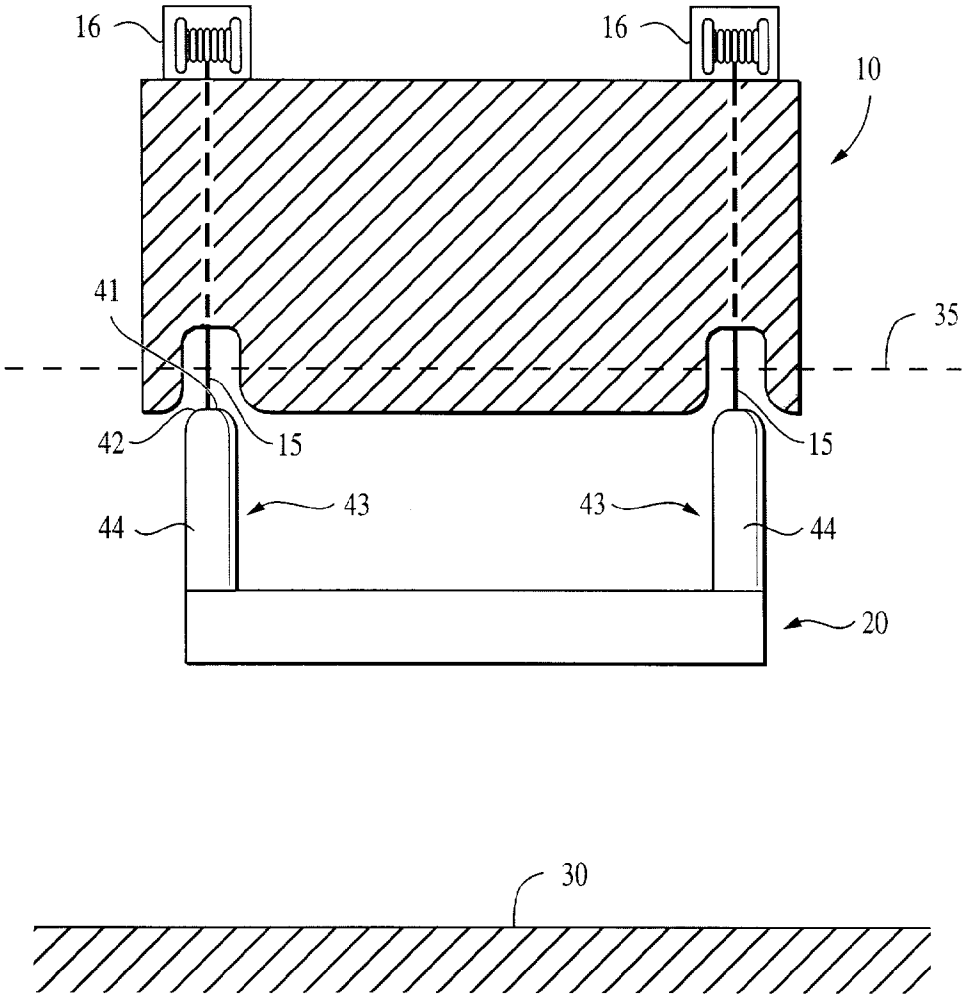
FIG. 12*b* illustrates an alternative embodiment of the inventive method showing a buoyant substructure with multiple deck support legs suspended below the self-floating deck structure from the lifting device.

In an alternative embodiment of the methods of the present invention, as is illustrated in FIG. 12*a*, a plurality of lifting lines 15 from a plurality of lifting devices 16 on the self-floating deck structure 10 are connected to the top surfaces 41 of the deck support legs 43 of the buoyant substructure 20. It is also understood that the methods of the present invention can be practiced such that the deck support leg top surface 41 and the deck support leg sidewall 44 adjacent to the deck support leg top surface 41 are adapted to fit within a recessed cavity 11 of the self-floating deck structure 10 and are sized so the circumferential dimension of the circumferential edge 42 of the deck support leg 43 is smaller than the circumferential dimension of the deck leg sidewall 44. Although this alternative embodiment shows the lifting lines 15 connected to the top surfaces 41 of the deck support legs 43, the inventive methods can be practiced with the lifting lines 15 connected to other points present on the deck support legs 43 or on the buoyant substructure 20. The submerged buoyant substructure 20 is preferably suspended below the self-floating deck structure 10 by the lines 15 connected to the lifting devices 16, as is illustrated in FIG. 12*b*.

Figure 13:
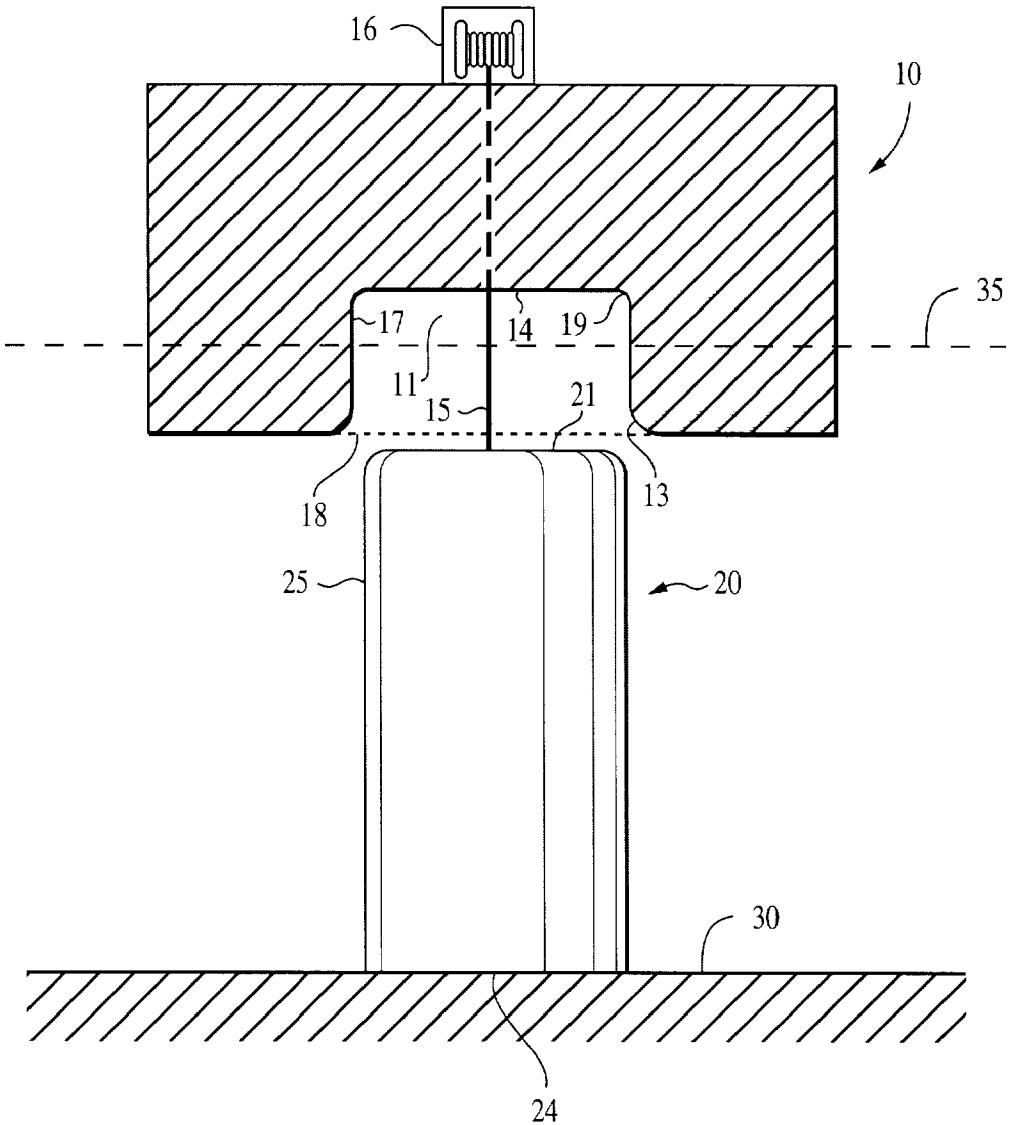

In an alternative embodiment of the method of the present invention, as is shown in FIG. 13, a self-floating deck structure 10 having a recessed cavity 11 is positioned adjacent to a floating buoyant substructure 20. A lifting line is connected at one end to a lifting device 16 located on the self-floating deck structure 10 is connected at the opposite end to the buoyant substructure 20. The buoyant substructure 20 is preferably ballasted down below the water surface 35 until it is totally submerged, and until the bottom surface 24 of the buoyant substructure 20 is resting on the seabed 30 in water sufficiently deep such that there is clearance between the bottom surface 12 of the self-floating deck structure 10 and the top surface 21 of the buoyant substructure 20 when the self-floating deck structure 10 is positioned over the submerged buoyant substructure 20. The self-floating deck structure 10 is preferably positioned over the submerged buoyant substructure 20 so that the recessed cavity 11 of the self-floating deck structure 10 is aligned over the top surface 21 of the buoyant substructure 20. The lifting device 16 preferably retracts the lifting line 15 until the buoyant substructure top surface 21 is inserted into the recessed cavity 11 of the self-floating deck structure 10, and the top surface 21 of the buoyant substructure 20 mates with the ceiling surface 14 of the recessed cavity 11.

Figure 14:
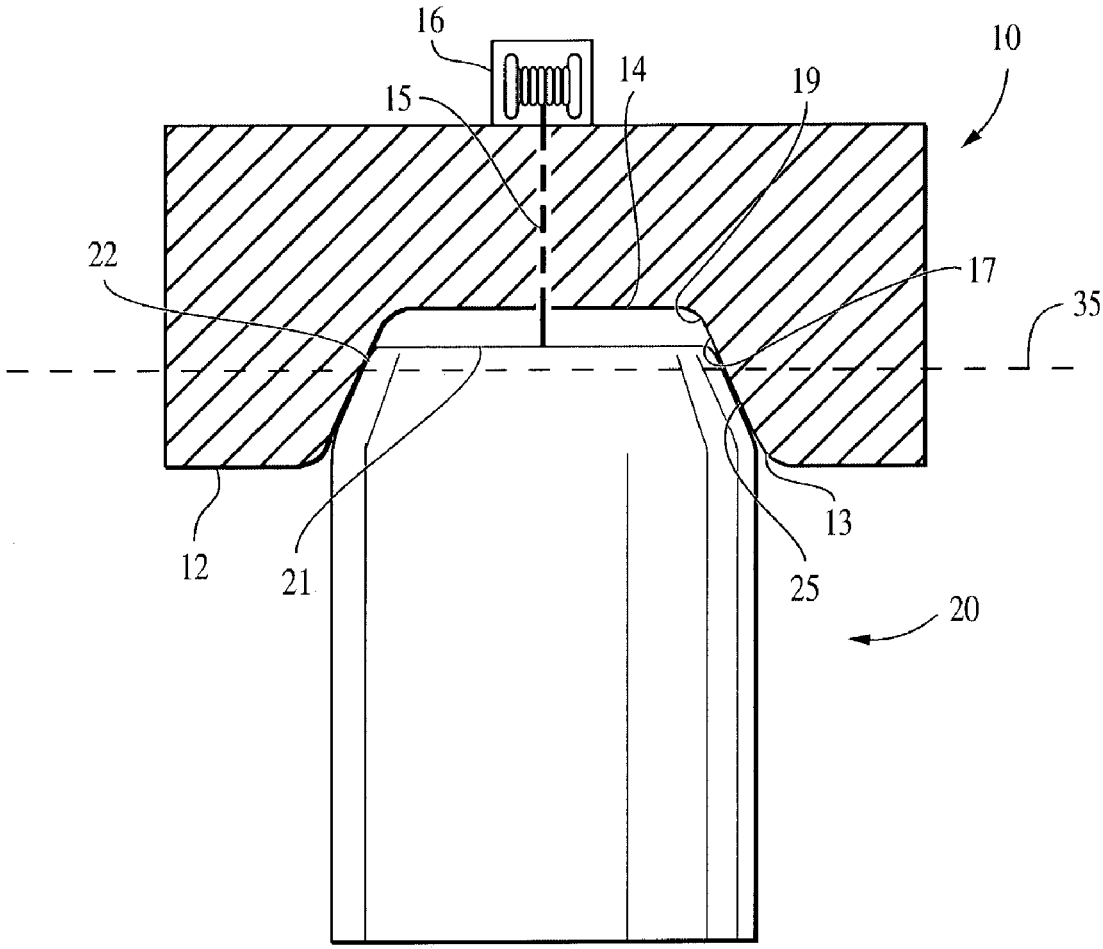

In another embodiment of the methods of the present invention, as is shown in FIG. 14, the circumferential dimension of the upper circumferential edge 19 of the recessed cavity 11 is preferably smaller than the circumferential dimension of the lower circumferential edge 13 of the recessed cavity 11. The circumferential dimension of the upper circumferential edge 22 of the buoyant substructure 20 is preferably larger than the circumferential dimension of the upper circumferential edge 19 of the recessed cavity 11, and preferably smaller than the circumferential dimension of the lower circumferential edge 13 of the recessed cavity 11. The buoyant substructure top surface 21 and the buoyant substructure sidewall 25 adjacent to the buoyant substructure top surface 21 are preferably adapted to fit within the recessed cavity 11 of the self-floating deck structure 10, and are preferably sized so that the buoyant substructure sidewall 25 mates snugly with the recessed cavity sidewall 17 when the buoyant substructure top surface 21 is inserted into the recessed cavity 11. A line 15 connected at one end to a lifting device 16 located on the self-floating deck structure 10 is lowered through the recessed cavity 11 present therein, and is connected at the opposite end to the buoyant substructure 20. The buoyant substructure 20 is preferably ballasted down below the water surface 35 until it is totally submerged in the water, and the buoyant substructure 20 is suspended from the self-floating deck structure 10 by the line 15 connected to the lifting device 16. The self-floating deck structure 10 is preferably positioned over the buoyant substructure 20 so that the recessed cavity 11 is aligned over the buoyant substructure top surface 21. The lifting device 16 retracts the line 15 connected to the buoyant substructure 20, thereby lifting the buoyant substructure top surface 21 into the recessed cavity 11 until the buoyant substructure sidewall 25 mates with the recessed cavity sidewall 17.

Figure 15A:
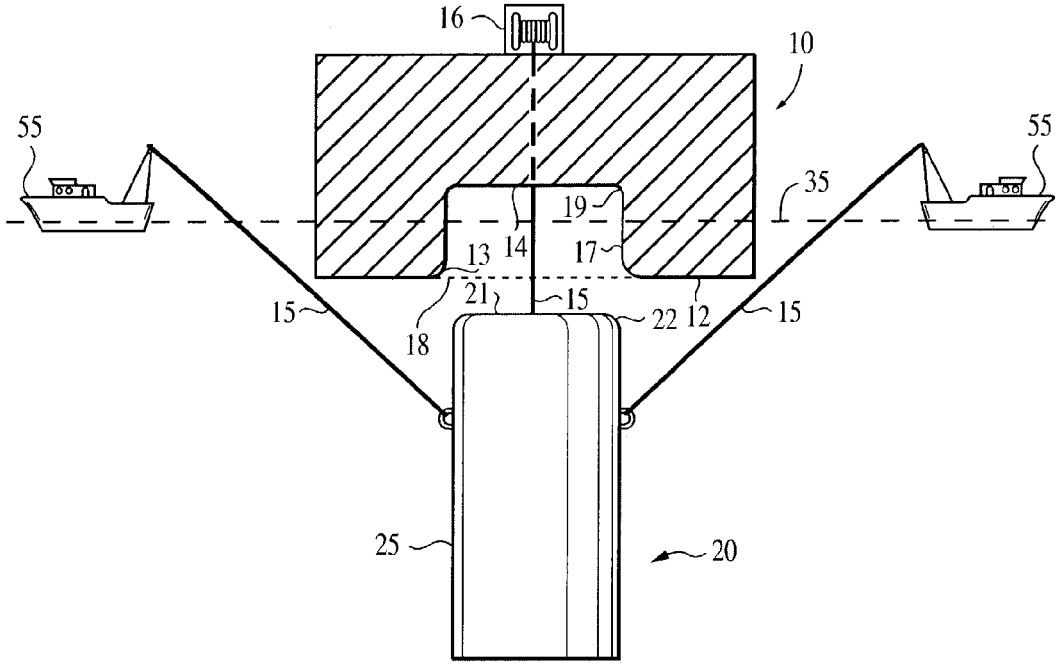

In another embodiment of the methods as shown in FIG. 15*a*, a plurality of floating vessels 55 are provided, each floating vessel having at least one line 15, said line being connected on one end to the vessel 55, the opposite end of each line being connected to the buoyant substructure 20 to prevent the buoyant substructure 20 from sinking to the seabed after the buoyant substructure 20 is ballasted below the water surface 35. As shown in FIG. 15*a*, two floating vessels 55 are depicted, however, it is recognized that the inventive method can be practiced with one or a plurality of floating vessels 55 (3, 4, 5, etc.).

Figure 15B:
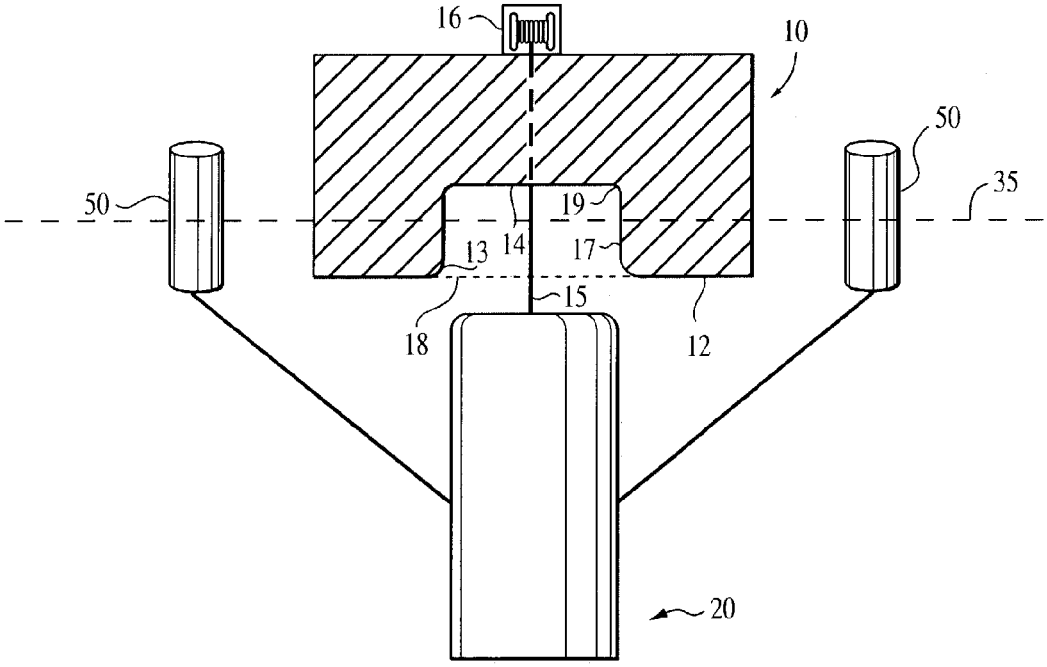

In the embodiment shown in FIG. 15*b*, a plurality of buoyancy tanks 50 are connected by a line to the buoyant substructure 20 to prevent the buoyant substructure 20 from sinking to the seabed after the buoyant substructure 20 is ballasted below the water surface 35. It is recognized that the inventive method is not restricted to two buoyancy tanks 50 as depicted but requires one or a plurality of buoyancy tanks 50 (3, 4, 5, etc.) be utilized.

It is recognized that the inventive methods can be practiced by ballasting the self-floating deck structure 10 down to facilitate the mating of the buoyant substructure top surface 21 or at least one deck support leg top surface 41 and at least one recessed cavity ceiling surface 14 of the self-floating deck structure 10.

The dimensions of these structures can vary widely as known by those with skill in the art. The materials used to fabricate these structures can vary but are typically metal or composite materials.

Certain preferred embodiments of the methods of the present invention have been illustrated and described herein. Because many varying and differing embodiments of the methods of the present invention may be made within the scope of the inventive concepts herein taught, and because many variations, modifications and substitutions of that which has been illustrated and described herein, such as by adding, combining, or by subdividing parts or steps, or by substituting equivalents, may be made to the embodiments of the present invention herein detailed, it is to be understood that the details of the present invention set forth herein are to be interpreted as illustrative, and not in a limiting sense. It is intended, therefore, that all of those modifications, variations and substitutions within the scope and spirit of the present invention as illustrated, described and claimed herein, and that the claims that follow be interpreted as broadly as possible.

What is claimed is:

1. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) injecting compressed air or gas into at least one recessed cavity of the self-floating deck structure until a portion or all of the water within said recessed cavity is expelled;

(d) positioning said self-floating deck structure adjacent to said buoyant substructure;

(e) lowering at least one line connected to at least one lifting device located on the self-floating deck structure and connecting each of line to the buoyant substructure;

(f) ballasting the buoyant substructure below the water surface until the buoyant substructure top surface is below the bottom surface of the self-floating deck structure and the buoyant substructure is suspended from the self-floating deck structure by at least one line connected to at least one lifting device;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

2. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(d) positioning said self-floating deck structure adjacent to said buoyant substructure;

(e) lowering at least one line connected to at least one lifting device located on the self-floating deck structure and connecting each of line to the buoyant substructure;

(f) ballasting the buoyant substructure below the water surface until the buoyant substructure top surface is below the bottom surface of the self-floating deck structure and the buoyant substructure is suspended from the self-floating deck structure by at least one line connected to at least one lifting device;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

3. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) providing at least one floating vessel, each floating vessel having at least one line having one end connected to said floating vessel and an opposite end connected to the buoyant substructure, said line supporting the weight of the buoyant substructure to prevent said buoyant substructure from sinking to the seabed after the buoyant substructure is ballasted below the water surface;

(d) positioning said self-floating deck structure adjacent to said buoyant substructure;

(e) lowering at least one line connected to at least one lifting device located on the self-floating deck structure and connecting each of line to the buoyant substructure;

(f) ballasting the buoyant substructure below the water surface until the buoyant substructure top surface is below the bottom surface of the self-floating deck structure and the buoyant substructure is suspended from the self-floating deck structure by at least one line connected to at least one lifting device;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

4. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each of line to the buoyant substructure;

(e) ballasting the buoyant substructure below the water surface until the buoyant substructure top surface is below the bottom surface of the self-floating deck structure and the buoyant substructure is suspended from the self-floating deck structure by at least one line connected to at least one lifting device;

(f) positioning the self-floating deck structure over the buoyant substructure so that the recessed cavity of the self-floating deck structure is aligned over the buoyant substructure top surface;

(g) ballasting the self-floating deck structure down to facilitate the mating of the buoyant substructure top surface and the recessed cavity ceiling surface of the self-floating deck structure;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

5. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming a circumferential edge of the deck support leg, each deck support leg top surface and the deck support leg sidewall adjacent to said deck support leg top surface being adapted and sized to fit within a recessed cavity present in the self-floating deck structure; and wherein the deck support leg top surface and the deck support leg sidewall adjacent to the deck support leg top surface are adapted to fit within a recessed cavity of the self-floating deck structure and are sized so that circumferential dimension of the circumferential edge of the deck support leg is smaller than the circumferential dimension of the deck support leg sidewall;

(c) positioning said self-floating deck structure adjacent to said buoyant substructure;

(d) connecting at least one line connected to at least one lifting device located on the self-floating deck structure to the buoyant substructure;

(e) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(f) positioning the self-floating deck structure over the buoyant substructure so that each of the recessed cavities of the self-floating deck structure are aligned over a deck support leg top surface present on the buoyant substructure;

(g) activating each lifting device to lift the buoyant substructure up until each deck support leg top surface is inserted into a recessed cavity of the self-floating deck structure and each deck support leg top surface mates with a recessed cavity ceiling surface at a point above the water surface;

(h) connecting the self-floating deck structure to the buoyant substructure by welding or by a plurality of mechanical devices; and (i) deballasting the buoyant substructure to raise the self-floating deck structure to a predetermined elevation above the water surface.

6. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming a circumferential edge of the deck support leg, each deck support leg top surface and the deck support leg sidewall adjacent to said deck support leg top surface being adapted and sized to fit within a recessed cavity present in the self-floating deck structure;

(c) injecting compressed air or gas into at least one recessed cavity of the self-floating deck structure until a portion or all of the water within said recessed cavity is expelled;

(d) positioning said self-floating deck structure adjacent to said buoyant substructure;

(e) connecting at least one line connected to at least one lifting device located on the self-floating deck structure to the buoyant substructure;

(f) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(g) positioning the self-floating deck structure over the buoyant substructure so that each of the recessed cavities of the self-floating deck structure are aligned over a deck support leg top surface present on the buoyant substructure;

(h) activating each lifting device to lift the buoyant substructure up until each deck support leg top surface is inserted into a recessed cavity of the self-floating deck structure and each deck support leg top surface mates with a recessed cavity ceiling surface at a point above the water surface;

(i) connecting the self-floating deck structure to the buoyant substructure by welding or by a plurality of mechanical devices; and (j) deballasting the buoyant substructure to raise the self-floating deck structure to a predetermined elevation above the water surface.

7. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one o lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming a circumferential edge of the deck support leg, each deck support leg top surface and the deck support leg sidewall adjacent to said deck support leg top surface being adapted and sized to fit within a recessed cavity present in the self-floating deck structure;

(c) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(d) positioning said self-floating deck structure adjacent to said buoyant substructure;

(e) connecting at least one line connected to at least one lifting device located on the self-floating deck structure to the buoyant substructure;

(f) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(g) positioning the self-floating deck structure over the buoyant substructure so that each of the recessed cavities of the self-floating deck structure are aligned over a deck support leg top surface present on the buoyant substructure;

(h) activating each lifting device to lift the buoyant substructure up until each deck support leg top surface is inserted into a recessed cavity of the self-floating deck structure and each deck support leg top surface mates with a recessed cavity ceiling surface at a point above the water surface;

(i) connecting the self-floating deck structure to the buoyant substructure by welding or by a plurality of mechanical devices; and (j) deballasting the buoyant substructure to raise the self-floating deck structure to a predetermined elevation above the water surface.

8. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming a circumferential edge of the deck support leg, each deck support leg top surface and the deck support leg sidewall adjacent to said deck support leg top surface being adapted and sized to fit within a recessed cavity present in the self-floating deck structure;

(c) positioning said self-floating deck structure adjacent to said buoyant substructure;

(d) connecting at least one line connected to at least one lifting device located on the self-floating deck structure to the buoyant substructure;

(e) ballasting the buoyant substructure below the water surface until the deck support leg top surface of each deck support leg is below the bottom surface of the self-floating deck structure and the buoyant substructure is suspended from the self-floating deck structure by at least one line connected to at least one lifting device;

(f) positioning the self-floating deck structure over the buoyant substructure so that each of the recessed cavities of the self-floating deck structure are aligned over a deck support leg top surface present on the buoyant substructure;

(g) ballasting the self-floating deck structure down to facilitate the mating of at least one deck support leg top surface and at least one recessed cavity ceiling surface;

(h) activating each lifting device to lift the buoyant substructure up until each deck support leg top surface is inserted into a recessed cavity of the self-floating deck structure and each deck support leg top surface mates with a recessed cavity ceiling surface at a point above the water surface;

(i) connecting the self-floating deck structure to the buoyant substructure by welding or by a plurality of mechanical devices; and (j) deballasting the buoyant substructure to raise the self-floating deck structure to a predetermined elevation above the water surface.

9. A method for installing a self-floating deck structure onto a buoyant substructure, said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) injecting compressed air or gas into at least one recessed cavity of the self-floating deck structure until a portion or all of the water within said recessed cavity is expelled;

(d) positioning the self-floating deck structure adjacent to said buoyant substructure and connecting at least one line connected to at least one lifting device located on the self-floating deck structure to the buoyant substructure;

(e) ballasting the buoyant substructure below the water surface until the buoyant substructure bottom surface rests upon a seabed present in the water deep enough so that the buoyant substructure top surface is below the bottom surface of the self-floating deck structure;

(f) positioning the self-floating deck structure over the submerged buoyant substructure so that the recessed cavity of the self-floating deck structure is aligned over the buoyant substructure top surface;

(g) activating at least one lifting device to lift the buoyant substructure top surface up into the recessed cavity of the self-floating deck structure until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface suitable for towing the connected self-floating deck structure and buoyant substructure to a final installation location.

10. A method for installing a self-floating deck structure onto a buoyant substructure, said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning the self-floating deck structure adjacent to said buoyant substructure and connecting at least one line connected to at least one lifting device located on the self-floating deck structure to the buoyant substructure;

(d) ballasting the buoyant substructure below the water surface until the buoyant substructure bottom surface rests upon a seabed present in the water deep enough so that the buoyant substructure top surface is below the bottom surface of the self-floating deck structure;

(e) positioning the self-floating deck structure over the submerged buoyant substructure so that the recessed cavity of the self-floating deck structure is aligned over the buoyant substructure top surface;

(f) activating at least one lifting device to lift the buoyant substructure top surface up into the recessed cavity of the self-floating deck structure until the buoyant substructure top surface mates with the recessed cavity ceiling surface at a point above the water surface;

(g) ballasting the self-floating deck structure down to facilitate the mating of the buoyant substructure top surface and the recessed cavity ceiling surface of the self-floating deck structure;

(h) connecting the self-floating deck structure to the buoyant substructure by welding or by one or more mechanical devices; and (i) deballasting the buoyant substructure to raise the self-floating deck structure to a predetermined elevation above the water surface suitable for towing the connected self-floating deck structure and buoyant substructure to a final installation location.

11. A method for installing a self-floating deck structure onto a buoyant substructure, said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) injecting compressed air or gas is injected into at least one recessed cavity of the self-floating deck structure until a portion of or all the water within said recessed cavity is expelled;

(d) positioning the self-floating deck structure adjacent to said buoyant substructure and connecting at least one line connected to at least one lifting device located on the self-floating deck structure to the buoyant substructure;

(e) ballasting the buoyant substructure below the water surface until the buoyant substructure bottom surface rests upon a seabed present in the water deer enough so that the buoyant substructure top surface is below the bottom surface of the self-floating deck structure;

(f) positioning the self-floating deck structure over the submerged buoyant substructure so that the recessed cavity of the self-floating deck structure is aligned over the buoyant substructure top surface;

(g) activating at least one lifting device to lift the buoyant substructure top surface up into the recessed cavity of the self-floating deck structure until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface suitable for towing the connected self-floating deck structure and buoyant substructure to a final installation location.

12. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above a water surface, the intersection of the recessed cavity sidewall and the recessed cavity ceiling surface forming an upper circumferential edge of the recessed cavity, and the intersection of the recessed cavity sidewall and the bottom surface of the self-floating deck structure forming at least one lower circumferential edge of the recessed cavity;

(b) providing a buoyant substructure that has a buoyant substructure bottom surface and a plurality of deck support legs, and that is capable of being fully submerged below the water surface, each deck support leg having a deck support leg ton surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) positioning the self-floating deck structure adjacent to said buoyant substructure and connecting at least one line connected to at least one lifting device present on the self-floating deck structure to the buoyant substructure;

(d) ballasting the buoyant substructure below the water surface until the buoyant substructure bottom surface rests upon a seabed present in the water deep enough so that each deck support leg top surface is positioned below the bottom surface of the self-floating deck structure;

(e) positioning the self-floating deck structure over the buoyant substructure so that each of the recessed cavities of the self-floating deck structure is aligned over a deck support leg top surface of the buoyant substructure;

(f) activating at least one lifting device to lift the buoyant substructure up until each deck support leg top surface is inserted into a recessed cavity of the self-floating deck structure and each deck support leg top surface mates with the recessed cavity ceiling surface at a point above the water surface;

(g) ballasting the self-floating deck structure down to facilitate the mating of at least one deck support leg top surface and at least one recessed cavity ceiling surface;

(h) connecting the self-floating deck structure to the buoyant substructure by welding or by one or more mechanical devices; and (i) deballasting the buoyant substructure to raise the self-floating deck structure to a predetermined elevation above the water surface.

13. A method for installing a self-floating deck structure onto a buoyant substructure, said method comprising the steps of:

(a) providing a self-floating deck structure with a bottom surface and a recessed cavity extending upward from said bottom surface of the self-floating deck structure, said recessed cavity comprising an opened end, at least one recessed cavity sidewall and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and said buoyant substructure bottom surface being connected by at least one buoyant substructure sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) injecting compressed air or gas is injected into at least one recessed cavity of the self-floating deck structure until a portion of or all the water within said recessed cavity is expelled;

(d) positioning said self-floating deck structure adjacent to said buoyant substructure;

(e) providing at least one line that is connected to the self-floating deck structure;

(f) connecting each line to the buoyant substructure;

(g) ballasting the buoyant substructure below the water surface until the buoyant substructure top surface is below the bottom surface of the self-floating deck structure and the buoyant substructure is suspended from the self-floating deck structure by at least one line;

(h) positioning the self-floating deck structure over the buoyant substructure so that the recessed cavity of the self-floating deck structure is aligned over the buoyant substructure top surface;

(i) raising the buoyant substructure top surface up into the recessed cavity by adjusting the buoyancy of the buoyant substructure until the buoyant substructure top surface mates with the recessed cavity ceiling surface at a point above the water surface;

(j) connecting the self-floating deck structure to the buoyant substructure by welding or by one or more mechanical device; and (k) deballasting the buoyant substructure to raise the self-floating deck structure to a predetermined elevation above the water surface.

14. A method for installing a self-floating deck structure onto a buoyant substructure, said method comprising the steps of:

(a) providing a self-floating deck structure with a bottom surface and a recessed cavity extending upward from said bottom surface of the self-floating deck structure, said recessed cavity comprising an opened end, at least one recessed cavity sidewall and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and said buoyant substructure bottom surface being connected by at least one buoyant substructure sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(d) positioning said self-floating deck structure adjacent to said buoyant substructure;

(e) providing at least one line that is connected to the self-floating deck structure;

(f) connecting each line to the buoyant substructure;

(g) ballasting the buoyant substructure below the water surface until the buoyant substructure top surface is below the bottom surface of the self-floating deck structure and the buoyant substructure is suspended from the self-floating deck structure by at least one line;

(h) positioning the self-floating deck structure over the buoyant substructure so that the recessed cavity of the self-floating deck structure is aligned over the buoyant substructure top surface;

(i) raising the buoyant substructure top surface up into the recessed cavity by adjusting the buoyancy of the buoyant substructure until the buoyant substructure top surface mates with the recessed cavity ceiling surface at a point above the water surface;

(j) connecting the self-floating deck structure to the buoyant substructure by welding or by one or more mechanical device; and (k) deballasting the buoyant substructure to raise the self-floating deck structure to a predetermined elevation above the water surface.

15. A method for installing a self-floating deck structure onto a buoyant substructure, said method comprising the steps of:

(a) providing a self-floating deck structure with a bottom surface and a recessed cavity extending upward from said bottom surface of the self-floating deck structure, said recessed cavity comprising an opened end, at least one recessed cavity sidewall and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and said buoyant substructure bottom surface being connected by at least one buoyant substructure sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) providing at least one floating vessel, each floating vessel having at least one line having one end connected to said floating vessel and an opposite end connected to the buoyant substructure, said line supporting the weight of the buoyant substructure to prevent said buoyant substructure from sinking to the seabed as the buoyant substructure is ballasted below the water surface;

(d) positioning said self-floating deck structure adjacent to said buoyant substructure;

(e) providing at least one line that is connected to the self-floating deck structure;

(f) connecting each line to the buoyant substructure;

(g) ballasting the buoyant substructure below the water surface until the buoyant substructure top surface is below the bottom surface of the self-floating deck structure and the buoyant substructure is suspended from the self-floating deck structure by at least one line;

(h) positioning the self-floating deck structure over the buoyant substructure so that the recessed cavity of the self-floating deck structure is aligned over the buoyant substructure top surface;

(i) raising the buoyant substructure top surface up into the recessed cavity by adjusting the buoyancy of the buoyant substructure until the buoyant substructure top surface mates with the recessed cavity ceiling surface at a point above the water surface;

(j) connecting the self-floating deck structure to the buoyant substructure by welding or by one or more mechanical device; and (k) deballasting the buoyant substructure to raise the self-floating deck structure to a predetermined elevation above the water surface.

16. A method for installing a self-floating deck structure onto a buoyant substructure, said method comprising the steps of:

(a) providing a self-floating deck structure with a bottom surface and a recessed cavity extending upward from said bottom surface of the self-floating deck structure, said recessed cavity comprising an opened end, at least one recessed cavity sidewall and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and said buoyant substructure bottom surface being connected by at least one buoyant substructure sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) providing at least one line that is connected to the self-floating deck structure;

(e) connecting each line to the buoyant substructure;

(f) ballasting the buoyant substructure below the water surface until the buoyant substructure top surface is below the bottom surface of the self-floating deck structure and the buoyant substructure is suspended from the self-floating deck structure by at least one line;

(g) ballasting the self-floating deck structure down to facilitate the mating of the buoyant substructure top surface and the recessed cavity ceiling surface of the self-floating deck structure;

(h) positioning the self-floating deck structure over the buoyant substructure so that the recessed cavity of the self-floating deck structure is aligned over the buoyant substructure top surface;

(i) raising the buoyant substructure top surface up into the recessed cavity by adjusting the buoyancy of the buoyant substructure until the buoyant substructure top surface mates with the recessed cavity ceiling surface at a point above the water surface;

(j) connecting the self-floating deck structure to the buoyant substructure by welding or by one or more mechanical device; and (k) deballasting the buoyant substructure to raise the self-floating deck structure to a predetermined elevation above the water surface.

17. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewalls and the recessed cavity ceiling surfaces forming at least one upper circumferential edge of the recessed cavity, and the intersection of the recessed cavity sidewalls and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, said buoyant substructure having a buoyant substructure bottom surface, each deck support leg having a deck support leg top surface and a deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) injecting compressed air or gas is injected into at least one recessed cavity of the self-floating deck structure until a portion of or all the water within said recessed cavity is expelled;

(d) positioning said self-floating deck structure adjacent to said buoyant substructure;

(e) providing at least one line that is connected to said self-floating deck structure;

(f) connecting each line to the buoyant substructure;

(g) ballasting the buoyant substructure below the water surface until the deck support leg top surface of each deck support leg of the buoyant substructure is below the bottom surface of the self-floating deck structure and the buoyant substructure is suspended from at least one line connected to the self-floating deck structure;

(h) positioning the self-floating deck structure over the buoyant substructure so that each of the recessed cavities of the self-floating deck structure are aligned over a deck support leg top surface of the buoyant substructure;

(i) raising the buoyant substructure up by adjusting the buoyancy of the buoyant substructure until each of deck support leg top surface is inserted into a recessed cavity of the self-floating deck structure and each deck support leg top surface mates with a recessed cavity ceiling surface at a point above the water surface;

(j) connecting the self-floating deck structure to the buoyant substructure of the self-floating deck structure by welding or by one or more mechanical devices; and (k) deballasting the buoyant substructure to raise the self-floating deck structure to a predetermined elevation above the water surface.

18. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewalls and the recessed cavity ceiling surfaces forming at least one upper circumferential edge of the recessed cavity, and the intersection of the recessed cavity sidewalls and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, said buoyant substructure having a buoyant substructure bottom surface, each deck support leg having a deck support leg top surface and a deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(d) positioning said self-floating deck structure adjacent to said buoyant substructure;

(e) providing at least one line that is connected to said self-floating deck structure;

(f) connecting each line to the buoyant substructure;

(g) ballasting the buoyant substructure below the water surface until the deck support leg top surface of each deck support leg of the buoyant substructure is below the bottom surface of the self-floating deck structure and the buoyant substructure is suspended from at least one line connected to the self-floating deck structure;

(h) positioning the self-floating deck structure over the buoyant substructure so that each of the recessed cavities of the self-floating deck structure are aligned over a deck support leg top surface of the buoyant substructure;

(i) raising the buoyant substructure up by adjusting the buoyancy of the buoyant substructure until each of deck support leg top surface is inserted into a recessed cavity of the self-floating deck structure and each deck support leg top surface mates with a recessed cavity ceiling surface at a point above the water surface;

(j) connecting the self-floating deck structure to the buoyant substructure of the self-floating deck structure by welding or by one or more mechanical devices; and (k) deballasting the buoyant substructure to raise the self-floating deck structure to a predetermined elevation above the water surface.

19. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewalls and the recessed cavity ceiling surfaces forming at least one upper circumferential edge of the recessed cavity, and the intersection of the recessed cavity sidewalls and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, said buoyant substructure having a buoyant substructure bottom surface, each deck support leg having a deck support leg top surface and a deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) providing at least one floating vessel, each floating vessel having at least one line having one end connected to said floating vessel and an opposite end connected to the buoyant substructure, said line supporting the weight of the buoyant substructure to prevent said buoyant substructure from sinking to the seabed as the buoyant substructure is ballasted below the water surface;

(d) positioning said self-floating deck structure adjacent to said buoyant substructure;

(e) providing at least one line that is connected to said self-floating deck structure;

(f) connecting each line to the buoyant substructure;

(g) ballasting the buoyant substructure below the water surface until the deck support leg top surface of each deck support leg of the buoyant substructure is below the bottom surface of the self-floating deck structure and the buoyant substructure is suspended from at least one line connected to the self-floating deck structure;

(h) positioning the self-floating deck structure over the buoyant substructure so that each of the recessed cavities of the self-floating deck structure are aligned over a deck support leg top surface of the buoyant substructure;

(i) raising the buoyant substructure up by adjusting the buoyancy of the buoyant substructure until each of deck support leg top surface is inserted into a recessed cavity of the self-floating deck structure and each deck support leg top surface mates with a recessed cavity ceiling surface at a point above the water surface;

(j) connecting the self-floating deck structure to the buoyant substructure of the self-floating deck structure by welding or by one or more mechanical devices; and (k) deballasting the buoyant substructure to raise the self-floating deck structure to a predetermined elevation above the water surface.

20. A method for installing a self-floating deck structure onto a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewalls and the recessed cavity ceiling surfaces forming at least one upper circumferential edge of the recessed cavity, and the intersection of the recessed cavity sidewalls and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, said buoyant substructure having a buoyant substructure bottom surface, each deck support leg having a deck support leg top surface and a deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) positioning said self-floating deck structure adjacent to said buoyant substructure;

(d) providing at least one line that is connected to said self-floating deck structure;

(e) connecting each line to the buoyant substructure;

(f) ballasting the buoyant substructure below the water surface until the deck support leg top surface of each deck support leg of the buoyant substructure is below the bottom surface of the self-floating deck structure and the buoyant substructure is suspended from at least one line connected to the self-floating deck structure;

(g) ballasting the self-floating deck structure down to facilitate the mating of at least one deck support leg top surface and at least one recessed cavity ceiling surface;

(h) positioning the self-floating deck structure over the buoyant substructure so that each of the recessed cavities of the self-floating deck structure are aligned over a deck support leg top surface of the buoyant substructure;

(i) raising the buoyant substructure up by adjusting the buoyancy of the buoyant substructure until each of deck support leg top surface is inserted into a recessed cavity of the self-floating deck structure and each deck support leg top surface mates with a recessed cavity ceiling surface at a point above the water surface;

(j) connecting the self-floating deck structure to the buoyant substructure of the self-floating deck structure by welding or by one or more mechanical devices; and (k) deballasting the buoyant substructure to raise the self-floating deck structure to a predetermined elevation above the water surface.

21. A method of installing a self-floating deck structure on to a buoyant substructure, said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) injecting compressed air or gas is injected into at least one recessed cavity of the self-floating deck structure until a portion of or all the water within said recessed cavity is expelled;

(d) positioning the self-floating deck structure adjacent to said buoyant substructure that has been ballasted below the water surface so that the buoyant substructure bottom surface rests on a seabed present in the water deep enough such that the buoyant substructure top surface is below the bottom surface of the self-floating deck structure;

(e) positioning the self-floating deck structure over the submerged buoyant substructure so that the recessed cavity of the self-floating deck structure is aligned over the buoyant substructure top surface;

(f) raising the buoyant substructure top surface up into the recessed cavity of the self-floating deck structure by adjusting the buoyancy of the buoyant substructure until the buoyant substructure top surface mates with the recessed cavity ceiling surface at a point above the water surface;

(g) connecting the self-floating deck structure to the buoyant substructure by welding or by one or more mechanical devices; and (h) deballasting the buoyant substructure to raise the self-floating deck structure to a predetermined elevation above the water surface suitable for towing the connected self-floating deck structure and buoyant substructure to a final installation location.

22. A method of installing a self-floating deck structure on to a buoyant substructure, said method comprising the steps of:

(a) providing a self-floating deck structure, said self-floating deck structure having a bottom surface and a recessed cavity extending upward from the bottom surface of the self-floating deck structure, said recessed cavity comprising an open end, at least one recessed cavity sidewall and a recessed cavity ceiling surface, said recessed cavity ceiling surface being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one sidewall, the intersection of the buoyant substructure top surface and the buoyant substructure sidewall forming at least one upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning the self-floating deck structure adjacent to said buoyant substructure that has been ballasted below the water surface so that the buoyant substructure bottom surface rests on a seabed present in the water deep enough such that the buoyant substructure top surface is below the bottom surface of the self-floating deck structure;

(d) positioning the self-floating deck structure over the submersed buoyant substructure so that the recessed cavity of the self-floating deck structure is aligned over the buoyant substructure top surface;

(e) raising the buoyant substructure top surface up into the recessed cavity of the self-floating deck structure by adjusting the buoyancy of the buoyant substructure until the buoyant substructure top surface mates with the recessed cavity ceiling surface at a point above the water surface;

(f) connecting the self-floating deck structure to the buoyant substructure by welding or by one or more mechanical devices;

(g) ballasting the self-floating deck structure down to facilitate the mating of the buoyant substructure top surface and the recessed cavity ceiling surface of the self-floating deck structure; and (h) deballasting the buoyant substructure to raise the self-floating deck structure to a predetermined elevation above the water surface suitable for towing the connected self-floating deck structure and buoyant substructure to a final installation location.

23. A method for installing a self-floating deck structure on to a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) injecting compressed air or gas is injected into at least one recessed cavity of the self-floating deck structure until a portion of or all the water within said recessed cavity is expelled;

(d) ballasting the buoyant substructure below the water surface until the buoyant substructure bottom surface rests on a seabed present in the water deep enough so that each deck support leg top surface is below the bottom surface of the self-floating deck structure;

(e) positioning the self-floating deck structure over the buoyant substructure so that each of the recessed cavities of the self-floating deck structure are aligned over a deck support leg top surface of the buoyant substructure;

(f) raising the buoyant substructure up by adjusting the buoyancy of the buoyant substructure until each deck support leg top surface is inserted into a recessed cavity of the self-floating deck structure and each deck support leg top surface mates with a recessed cavity ceiling surface at a point above the water surface;

(g) connecting the self-floating deck structure to the buoyant substructure of the self-floating deck structure by welding or by one or more mechanical devices; and (h) deballasting the buoyant substructure to raise the self-floating deck structure to a predetermined elevation above the water surface.

24. A method for installing a self-floating deck structure on to a buoyant substructure, said method comprising the steps of:

(a) providing a self-floating deck structure with a bottom surface and a plurality of recessed cavities extending upward from said bottom surface of the self-floating deck structure, each of said recessed cavities comprising an open end, at least one recessed cavity sidewall and a recessed cavity ceiling surface, each of said recessed cavity ceiling surfaces being positioned above the water surface, the intersection of the recessed cavity sidewall and the recessed cavity ceiling surface forming at least one upper circumferential edge of the recessed cavity, and the intersection of the recessed cavity sidewall and the bottom surface of the self-floating deck structure forming at least one lower circumferential edge of the recessed cavity;

(b) providing a buoyant substructure having a buoyant substructure bottom surface and a plurality of deck support legs, and that is capable of being fully submerged below the water surface, each deck support leg having a deck support leg top surface and at least one deck support leg sidewall, the intersection of each deck support leg top surface and each deck support leg sidewall forming at least one circumferential edge of the deck support leg, each deck support leg top surface and the deck support leg sidewall adjacent to said deck support leg top surface being adapted and sized to fit within a recessed cavity of the self-floating deck structure;

(c) ballasting the buoyant substructure below the water surface until the buoyant substructure bottom surface rests on a seabed present in the water deep enough so that each deck support leg top surface is below the bottom surface of the self-floating deck structure;

(d) positioning the self-floating deck structure over the buoyant substructure so that each of the recessed cavities of the self-floating deck structure are aligned over a deck support leg top surface of the buoyant substructure;

(e) raising the buoyant substructure up by adjusting the buoyancy of the buoyant substructure until each deck support leg top surface is inserted into a recessed cavity of the self-floating deck structure and each deck support leg top surface mates with a recessed cavity ceiling surface at a point above the water surface;

(f) connecting the self-floating deck structure to the buoyant substructure of the self-floating deck structure by welding or by one or more mechanical devices;

(g) ballasting the self-floating deck structure down to facilitate the mating of at least one deck support leg top surface and at least one recessed cavity ceiling surface; and (h) deballasting the buoyant substructure to raise the self-floating deck structure to a predetermined elevation above the water surface.

25. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(f) ballasting the buoyant substructure below the water surface until the buoyant substructure top surface is below the bottom surface of the self-floating deck structure and the buoyant substructure is suspended from at least one buoyancy tank by at least one line connected to at least one buoyancy tank;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

26. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) providing at least one buoyancy tank, each buoyancy tank having at least one line having one end connected to said buoyancy tank and an opposite end connected to the buoyant substructure to prevent said buoyant substructure from sinking to the seabed after the buoyant substructure is ballasted below the water surface;

(e) ballasting the buoyant substructure below the water surface until the buoyant substructure top surface is below the bottom surface of the self-floating deck structure and the buoyant substructure is suspended from at least one buoyancy tank by at least one line connected to at least one buoyancy tank;

(f) positioning the self-floating deck structure over the buoyant substructure so that the recessed cavity of the self-floating deck structure is aligned over the buoyant substructure top surface;

(g) raising the buoyant substructure top surface up into the recessed cavity by adjusting the buoyancy of the buoyant substructure until the buoyant substructure top surface mates with the recessed cavity ceiling surface at a point above the water surface;

(h) connecting the self-floating deck structure to the buoyant substructure by welding or by one or more mechanical devices; and (i) deballasting the buoyant substructure to raise the self-floating deck structure to a predetermined elevation above the water surface.

27. A method for installing a self-floating deck structure onto a buoyant substructure, said method comprising the steps of:

(a) providing a self-floating deck structure having a bottom surface and a recessed cavity extending upward from said bottom surface of the self-floating deck structure, said recessed cavity comprising an open end, at least one recessed cavity sidewall, and a recessed cavity ceiling surface, said recessed cavity ceiling surface being positioned above a water surface, the intersection of the recessed cavity sidewall and the recessed cavity ceiling surface forming at least one upper circumferential edge of the recessed cavity, and the intersection of the recessed cavity sidewall and the bottom surface of the self-floating deck forming at least one lower circumferential edge of the recessed cavity;

(b) providing a buoyant substructure that is capable of being fully submerged below the water surface, said buoyant substructure having a buoyant substructure top surface and a buoyant substructure bottom surface, said buoyant substructure top surface and buoyant substructure bottom surface being connected by at least one buoyant substructure sidewall, the intersection of the buoyant substructure top surface and the buoyant substructure sidewall forming an upper circumferential edge of the buoyant substructure, the buoyant substructure top surface and the buoyant substructure sidewall adjacent to the buoyant substructure top surface being adapted and sized to fit within the recessed cavity of the self-floating deck structure;

(c) positioning said self-floating deck structure adjacent to said buoyant substructure;

(d) lowering at least one line connected to at least one lifting device located on the self-floating deck structure and connecting each line to the buoyant substructure;

(e) providing at least one floating vessel, each floating vessel having at least one line having one end connected to said floating vessel and an opposite end connected to the buoyant substructure to prevent said buoyant substructure, said line supporting the weight of the buoyant substructure from sinking to the seabed after the buoyant substructure is ballasted below the water surface;

(f) ballasting the buoyant substructure below the water surface until the buoyant substructure top surface is below the bottom surface of the self-floating deck structure and the buoyant substructure is suspended from at least one floating vessel by at least one line connected to at least one floating vessel;

(g) positioning the self-floating deck structure over the buoyant substructure so that the recessed cavity of the self-floating deck structure is aligned over the buoyant substructure top surface;

(h) activating at least one lifting device to lift the buoyant substructure top surface up into the recessed cavity using at least one lifting device until the buoyant substructure top surface mates with the recessed cavity ceiling surface at a point above the water surface;

(i) connecting the self-floating deck structure to the buoyant substructure by welding or by one or more mechanical devices; and (j) deballasting the buoyant substructure to raise the self-floating deck structure to a predetermined elevation above the water surface.

* * * * *